US011189233B2

(12) United States Patent
Son et al.

(10) Patent No.: US 11,189,233 B2
(45) Date of Patent: Nov. 30, 2021

(54) DISPLAY DEVICE AND METHOD OF CONTROLLING BRIGHTNESS OF THE SAME BASED ON SAMPLE BRIGHTNESS LEVELS

(71) Applicant: Samsung Display Co., Ltd., Yongin-si (KR)

(72) Inventors: Min Seong Son, Yongin-si (KR); Hyun Jung Son, Yongin-si (KR); Jae Cheon Park, Yongin-si (KR); Seung Kyu Lee, Yongin-si (KR); Yoon Gyu Lee, Yongin-si (KR); Sun Joon Hwang, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/851,453

(22) Filed: Apr. 17, 2020

(65) Prior Publication Data

US 2020/0335042 A1 Oct. 22, 2020

(30) Foreign Application Priority Data

Apr. 18, 2019 (KR) ..... 10-2019-0045563
Jul. 2, 2019 (KR) ..... 10-2019-0079651

(51) Int. Cl.
*G09G 3/3208* (2016.01)
*G09G 3/3266* (2016.01)
*G09G 3/3275* (2016.01)

(52) U.S. Cl.
CPC ..... *G09G 3/3266* (2013.01); *G09G 3/3275* (2013.01); *G09G 2320/064* (2013.01); *G09G 2320/0673* (2013.01)

(58) Field of Classification Search
None
See application file for complete search history.

(56) References Cited

U.S. PATENT DOCUMENTS 8,259,044 B2 9/2012 Nathan et al.
9,053,664 B2 6/2015 Lee
(Continued)

FOREIGN PATENT DOCUMENTS

KR 10-2010-0042487 A 4/2010
KR 10-1492718 B1 2/2015
(Continued)

*Primary Examiner* — Stephen G Sherman
*Assistant Examiner* — Donna V Bocar
(74) *Attorney, Agent, or Firm* — Lewis Roca Rothgerber Christie LLP

(57) ABSTRACT

A display device includes a display driver configured to drive pixels in correspondence with input image data, timing signals, and a brightness selection signal. The display driver includes a storage unit configured to store gamma data and a duty value for each of a plurality of sample brightness levels including a K-th sample brightness level, and a brightness controller, the display driver being configured to control the brightness of the display area according to the gamma data or the duty value or gamma data obtained by non-linearly interpolating gamma data of a (K−1)-th sample brightness level and the K-th sample brightness level, with respect to a tuning point brightness level. A light emission time of the pixels corresponding to the (K−1)-th sample brightness level is less than or equal to 10% shorter than the light emission time of the pixels corresponding to the K-th sample brightness level.

20 Claims, 14 Drawing Sheets

(56) References Cited

U.S. PATENT DOCUMENTS

| | | | | |
|---|---|---|---|---|
| 9,269,294 | B2 | 2/2016 | Eom et al. | |
| 9,478,166 | B2 | 10/2016 | Pyo et al. | |
| 9,564,085 | B2 | 2/2017 | Jin et al. | |
| 9,858,894 | B2 | 1/2018 | Kim | |
| 9,940,863 | B2 | 4/2018 | An | |
| 2002/0024481 | A1* | 2/2002 | Kawabe | G09G 3/3611 345/87 |
| 2013/0127924 | A1* | 5/2013 | Lee | G09G 3/32 345/690 |
| 2013/0321485 | A1* | 12/2013 | Eom | G09G 3/3233 345/690 |
| 2014/0125714 | A1* | 5/2014 | Pyo | G09G 3/3233 345/691 |
| 2015/0138251 | A1* | 5/2015 | Pyo | G09G 3/3233 345/690 |
| 2017/0186375 | A1* | 6/2017 | Jung | G09G 3/3233 |
| 2017/0206825 | A1* | 7/2017 | Cha | G09G 3/3208 |
| 2017/0213493 | A1* | 7/2017 | Han | G09G 3/3208 |
| 2019/0088205 | A1* | 3/2019 | Zhang | G09G 3/3258 |
| 2020/0082768 | A1* | 3/2020 | Oh | G09G 3/3291 |

FOREIGN PATENT DOCUMENTS

| | | | |
|---|---|---|---|
| KR | 10-2015-0040095 | A | 4/2015 |
| KR | 10-2016-0125555 | A | 11/2016 |
| KR | 10-2016-0132247 | A | 11/2016 |
| KR | 10-1850994 | B1 | 4/2018 |
| KR | 10-1917757 | B1 | 11/2018 |

* cited by examiner

DISPLAY DEVICE AND METHOD OF CONTROLLING BRIGHTNESS OF THE SAME BASED ON SAMPLE BRIGHTNESS LEVELS

This application claims priority to and the benefit of Korean Patent Application No. 10-2019-0045563, filed on Apr. 18, 2019 and Korean Patent Application No. 10-2019-0079651, filed on Jul. 2, 2019 and all the content of which in its entirety is herein incorporated by reference.

BACKGROUND

1. Field

Aspects of embodiments of the present disclosure relate to a display device and a method of controlling a brightness of the same.

2. Description of the Related Art

In general, a display device determines a display brightness for each gray level through a gamma setting. For example, the display device may generate data signals corresponding to each gray level using gamma data preset with respect to reference gray levels (e.g., predetermined reference gray levels) and display an image at a brightness corresponding to the data signal.

In addition, the display device may select one of a plurality of preset brightness levels (for example, dimming levels) and control a brightness of a display area in correspondence with the selected brightness level. For example, the display device may determine a brightness level in correspondence with a brightness selection signal according to an initial setting, a usage environment, a user input, or the like, and may generate a data signal using gamma data corresponding to each brightness level to control a brightness of the display area.

SUMMARY

An object of the present disclosure is to provide a display device and a method of controlling a brightness of the same.

A display device according to an embodiment of the present disclosure includes a display area including pixels connected to scan lines, light emission control lines, and data lines, and a display driver configured to drive the pixels in accordance with input image data, timing signals, and a brightness selection signal. The display driver includes a storage unit configured to store gamma data and a duty value for each of a plurality of sample brightness levels including a K-th (K is a natural number of two or more) sample brightness level, and a brightness controller configured to control a brightness of the display area according to a brightness level corresponding to the brightness selection signal and with reference to the storage unit, and control a light emission time of the pixels according to the brightness level in a first brightness region equal to or less than the K-th sample brightness level. In addition, the display driver is configured to control the brightness of the display area according to the gamma data or the duty value or gamma data obtained by non-linearly interpolating gamma data of a (K−1)-th sample brightness level and the K-th sample brightness level, with respect to a tuning point brightness level. The light emission time of the pixels corresponding to the (K−1)-th sample brightness level is less than or equal to 10% shorter than the light emission time of the pixels corresponding to the K-th sample brightness level.

In an embodiment, the storage unit may be configured to store gamma data corresponding to the tuning point brightness level, and the tuning point brightness level may be set to the (K−1)-th sample brightness level.

In an embodiment, the (K−1)-th sample brightness level may be a brightness level at which the light emission time of the pixels is set to a range of 90% to 95% of the light emission time of the pixels corresponding to the K-th sample brightness level.

In an embodiment, the brightness controller may be configured to calculate each gamma data or duty value through non-linear interpolation with respect to at least one brightness level between the (K−1)-th sample brightness level and the K-th sample brightness level.

In an embodiment, the brightness controller may be configured to calculate each gamma data by using a quadratic function that sets the gamma data to gradually decrease the brightness of the display area and then increase again as each brightness level increases with respect to the at least one brightness level.

In an embodiment, the brightness controller may may be configured to calculate each duty value through linear interpolation with respect to brightness levels between the (K−1)-th sample brightness level and the K-th sample brightness level.

In an embodiment, the tuning point brightness level may be set to a brightness level between the (K−1)-th sample brightness level and the K-th sample brightness level, and the storage unit may be configured store a duty value corresponding to the brightness level between the (K−1)-th sample brightness level and the K-th sample brightness level.

In an embodiment, the brightness controller may be configured to calculate each duty value through non-linear interpolation using a quadratic function with respect to brightness levels between the (K−1)-th sample brightness level and the tuning point brightness level, and calculate each duty value through linear interpolation with respect to brightness levels between the tuning point brightness level and the K-th sample brightness level.

In an embodiment, the brightness controller may be configured to calculate each gamma data through linear interpolation with respect to brightness levels between the (K−1)-th sample brightness level and the K-th sample brightness level.

In an embodiment, the tuning point brightness level may be a brightness level at which the light emission time of the pixels is set to a range of 90% to 95% of the K-th sample brightness level.

In an embodiment, the brightness controller may be configured to calculate each gamma data and duty value through linear interpolation with respect to brightness levels between sample brightness levels equal to or less than the (K−1)-th sample brightness level and brightness levels between sample brightness levels equal to or greater than the K-th sample brightness level.

In an embodiment, the brightness controller may be configured to control the brightness of the display area by adjusting the light emission time of the pixels and gamma data of reference gray levels according to a first brightness control mode with respect to brightness levels of the first brightness region, and control the brightness of the display area by adjusting the gamma data of the reference gray levels according to a second brightness control mode with respect to brightness levels equal to or greater than the K-th sample brightness level.

In an embodiment, the brightness controller may be configured to output a light emission start signal having a pulse width corresponding to the light emission time of the pixels.

In an embodiment, the display driver may further include a light emission control driver that is configured to sequentially supply a light emission control signal to the light emission control lines in accordance with the light emission start signal.

In an embodiment, the brightness controller may be configured to adjust and output the pulse width of the light emission start signal so that an off duty value of the light emission control signal increases as the brightness level according to the brightness selection signal decreases in the first brightness control mode.

In an embodiment, the brightness controller may be configured to maintain the pulse width of the light emission start signal so that an off duty value of the light emission control signal remains constant regardless of the brightness level according to the brightness selection signal in the second brightness control mode.

In an embodiment, the display driver may further include a scan driver configured to sequentially supply a scan signal to the scan lines, the scan signal being synchronized with a gate-off period of the light emission control signal.

In an embodiment, the display driver may further include a data driver configured to generate data signals corresponding to the input image data by using the gamma data of the reference gray levels and supply the data signals to the data lines.

In an embodiment, the storage unit may include a multi time programming (MTP) register configured to store reference gamma voltages corresponding to predetermined reference gray levels for each of the plurality of sample brightness levels.

A method of controlling a brightness of a display device according to an embodiment of the present disclosure includes setting a plurality of sample brightness levels including a K-th (K is a natural number of two or more) sample brightness level, storing a plurality of sets of gamma data and a plurality of duty values, each of the sample brightness levels corresponding to one of the sets of gamma data and one of the duty values, executing a first brightness control mode or a second brightness control mode in accordance with a brightness selection signal, and controlling the brightness of a display area according to a brightness level corresponding to the brightness selection signal. When the brightness level is in a first brightness region equal to or less than the K-th sample brightness level, the brightness of the display area is controlled by controlling a light emission time of pixels, and the brightness of the display area is controlled according to pre-stored gamma data or duty value, or the brightness of the display area is controlled according to gamma data obtained by non-linearly interpolating gamma data of a (K−1)-th sample brightness level and the K-th sample brightness level, with respect to a predetermined brightness level at which the light emission time of the pixels is set to a range of 90% to 100% of the K-th sample brightness level.

According to the display device and the method of controlling the brightness of the same by an embodiment of the present disclosure, a brightness reversal phenomenon may be prevented from occurring between the brightness levels, and the brightness of the display area may be naturally controlled in correspondence with each brightness level.

BRIEF DESCRIPTION OF THE DRAWINGS

The above and other features of the present disclosure will become more apparent by describing in further detail embodiments thereof with reference to the accompanying drawings, in which.

DETAILED DESCRIPTION

Figure 1:
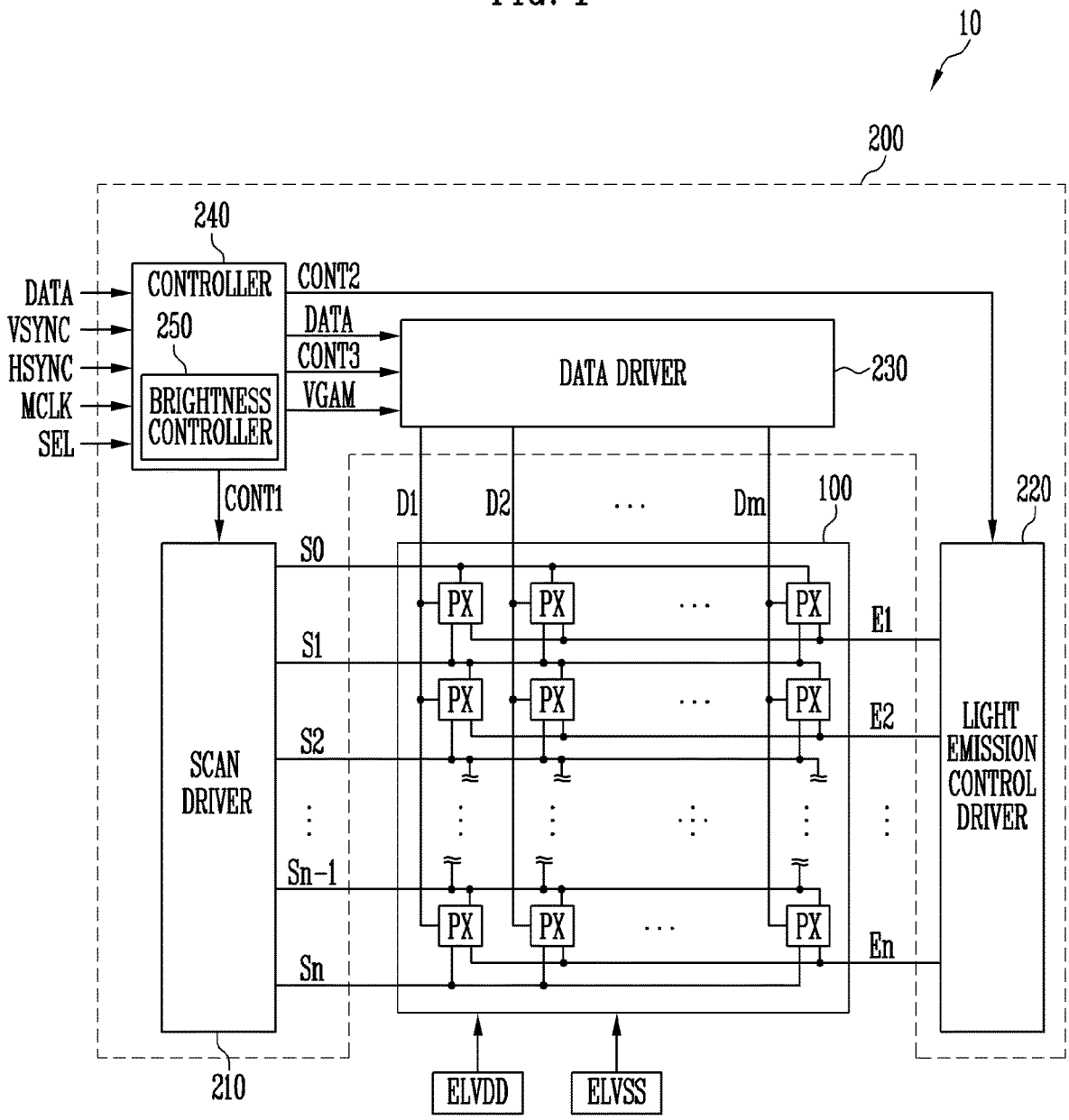
FIG. 1 is a schematic diagram illustrating a display device according to an embodiment of the present disclosure.

The disclosure may be modified in various ways and may have various forms, and specific embodiments will be shown in the drawings and described in detail herein. However, the disclosure is not limited to the embodiments disclosed below, and may be modified and carried out in various forms. In addition, in the following description, the singular expressions include plural expressions unless the context clearly dictates otherwise. It will be further understood that the terms "includes," "including," "comprises," and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items. Further, the use of "may" when describing embodiments of the present disclosure refers to "one or more embodiments of the present disclosure". It will be understood that when an element is referred to as being "connected to" another element, it may be connected to the other element or one or more intervening elements may also be present.

In the drawings, some components which are not directly related to a characteristic of the present disclosure may be omitted to clearly represent the present disclosure. In addition, some components in the drawings may be shown to be exaggerated in size or proportion. Throughout the drawings, the same or similar components will be denoted by the same reference numerals and symbols as much as possible even though they are shown in different drawings, and repetitive descriptions will be omitted.

FIG. 1 is a schematic diagram illustrating a display device 10 according to an embodiment of the present disclosure. Although an organic light emitting diode display device is shown in FIG. 1, embodiments of the present disclosure are not limited thereto.

Referring to FIG. 1, the display device 10 according to an embodiment of the present disclosure may include a display area 100 including a plurality of pixels PX, and a display driver 200 for driving the pixels PX.

The display area 100 includes scan lines S0 to Sn, light emission control lines E1 to En, data lines D1 to Dm crossing the scan lines S0 to Sn and the light emission control lines E1 to En, and the pixels PX connected to corresponding ones of the scan lines S0 to Sn, the light emission control lines E1 to En, and the data lines D1 to Dm. In describing an embodiment of the present disclosure, "connection" may mean a physical and/or electrical connection. For example, the pixels PX may be electrically connected to the scan lines S0 to Sn, the light emission control lines E1 to En, and the data lines D1 to Dm.

The scan lines S0 to Sn are connected between a scan driver 210 of the display driver 200 and the pixels PX. The scan lines S0 to Sn transfer scan signals output from the scan driver 210 to the pixels PX. The scan signals control a timing at which a data signal is input to each pixel PX.

The light emission control lines E1 to En are connected between a light emission control driver 220 of the display driver 200 and the pixels PX. The light emission control lines E1 to En transfer light emission control signals output from the light emission control driver 220 to the pixels PX. The light emission control signals control a light emission time of each pixel PX.

The data lines D1 to Dm are connected between a data driver 230 of the display driver 200 and the pixels PX. The data lines D1 to Dm transfer data signals output from the data driver 230 to the pixels PX. The data signals control a light emission brightness of each pixel PX.

The pixels PX receive respective scan signals, light emission control signals, and the data signals from the scan lines S0 to Sn, the light emission control lines E1 to En, and the data lines D1 to Dm. In addition, the pixels PX receive driving power from a power supply. For example, the pixels PX may receive a first power from a first power source ELVDD as a high potential driving power source and a second power from a second power source ELVSS as a low potential driving power. During each light emission period, each of the pixels PX emits light of a brightness corresponding to the data signal received for the light emission period. However, when a data signal corresponding to a black gray level (e.g., a 0 gray level) is supplied to each pixel PX, the pixel PX may maintain a non-light emitting state even during the light emission period of a corresponding frame.

In an embodiment, the pixels PX may be self-luminous pixels including respective light emitting elements, but are not limited thereto. For example, a type, a structure, and/or a driving method of the pixels PX may be variously changed in different embodiments.

The display driver 200 drives the pixels PX in correspondence with input image data DATA, timing signals (e.g., VSYNC, HSYNC, and MCLK), and a brightness selection signal SEL. The display driver 200 may include the scan driver 210, the light emission control driver 220, the data driver 230, and a controller 240 for controlling operations of the scan driver 210, the light emission control driver 220, and the data driver 230. According to an embodiment, the scan driver 210, the light emission control driver 220, the data driver 230, and/or the controller 240 may be integrated into one driving IC, but are not limited thereto.

The scan driver 210 receives a first control signal CONT1 from the controller 240 and supplies the scan signals to the scan lines S0 to Sn in accordance with the first control signal CONT1. For example, the scan driver 210 may receive the first control signal CONT1 including a scan start signal (e.g., a start pulse input to a first scan stage) and a scan clock signal, and may sequentially output the scan signals to the scan lines S0 to Sn in accordance with (e.g., in response to) the first control signal CONT1. The scan driver 210 may be formed or mounted on a display panel together with the pixels PX, or may be formed inside the driving IC or the like.

According to an embodiment, the scan driver 210 may supply the scan signals to the scan lines S0 to Sn so as to be synchronized with a gate-off period of the respective light emission control signals supplied to the light emission control lines E1 to En. For example, the scan driver 210 may supply a scan signal of a gate-on voltage for selecting the pixels PX of a first horizontal line through the first scan line S1 during a period in which the light emission control signal of a gate-off voltage is supplied to the pixels PX of the first horizontal line through the first light emission control line E1. When the pixels PX are selected in a horizontal line unit by each scan signal, the selected pixels PX receive a data signal of a corresponding frame from the data lines D1 to Dm.

The light emission control driver 220 receives a second control signal CONT2 from the controller 240, and supplies the light emission control signals to the light emission control lines E1 to En in accordance with the second control signal CONT2. For example, the light emission control driver 220 may receive the second control signal CONT2 including a light emission start signal (e.g., a start pulse input to a first light emission stage) and a light emission clock signal, and may sequentially output the light emission control signals to the light emission control lines E1 to En in accordance with (e.g., in response to) the second control signal CONT2.

The light emission control driver 220 may be formed or mounted on the display panel together with the pixels PX, or may be formed inside the driving IC or the like. In addition, the light emission control driver 220 may be integrated into one gate driver together with the scan driver 210 or may be formed or mounted separately from the scan driver 210.

According to an embodiment, the light emission control signal may have a gate-off voltage of a level (e.g., a predetermined level), and the gate-off voltage may be maintained for a time corresponding to an on/off duty value (e.g., a predetermined on/off duty value). Then, the pixels PX receiving each light emission control signal may be controlled not to emit light (e.g., to emit no light) during a period in which the light emission control signal has the gate-off voltage, and may be set to a state in which the pixels PX may emit light in accordance with the data signal during the remaining periods (e.g., the periods during which the light emission control signal has a gate-on voltage). For example, the light emission time of the pixels PX may be controlled by the light emission control signal.

The data driver 230 receives a third control signal CONT3 and the image data DATA from the controller 240 and generates data signals corresponding to the third control signal CONT3 and the image data DATA. The data signals are output to the data lines D1 to Dm. For example, the data driver 230 may receive the third control signal CONT3 including a source sampling pulse, a source sampling clock, a source output enable signal, and the like, and the image data DATA, and may output the data signals corresponding to a row of the pixels PX selected in a corresponding horizontal period (e.g., a corresponding period for storing data signals in a row of pixels) for each horizontal period (e.g., for each of the periods corresponding to the rows of pixels PX) to the data lines D1 to Dm. According to an embodiment, the data driver 230 may be formed or mounted on the display panel together with the pixels PX, or may be formed inside the driving IC or the like.

The controller 240 receives the timing signals and the image data DATA from the outside (e.g., from a host processor) and drives the scan driver 210, the light emission control driver 220, and the data driver 230 in accordance with the timing signals and the image data DATA. For example, the controller 240 may receive the timing signals including a vertical synchronization signal VSYNC, a horizontal synchronization signal HSYNC, a main clock signal MCLK, and the like, and may output the first, second, and third control signals CONT1, CONT2, and CONT3 in accordance with the timing signals. The first, second, and third control signals CONT1, CONT2, and CONT3 are supplied to the scan driver 210, the light emission control driver 220, and the data driver 230, respectively.

In addition, the controller 240 may rearrange the image data DATA according to a specification, a driving mode, and the like of the display panel and/or the data driver 230, and may output the rearranged image data DATA to the data driver 230. The image data DATA input to the data driver 230 is used to generate the data signal. According to various embodiments, the controller 240 may be configured as a timing controller or a signal controller including the timing controller.

In an embodiment of the present disclosure, the display device 10 may include information defining a plurality of preset brightness levels, and may be driven at a brightness corresponding to a selected brightness level among the brightness levels. According to an embodiment, the brightness levels are for gradually controlling an overall brightness of the display area 100 (e.g., a brightness of the pixels PX according to each brightness level). For example, the brightness levels may include a plurality of preset dimming levels.

In this case, the controller 240 may receive the brightness selection signal SEL from the outside, and may control the scan driver 210, the light emission control driver 220, and/or the data driver 230 so that the display area 100 emits light at an overall brightness level corresponding to the brightness selection signal SEL. According to an embodiment, the brightness selection signal SEL may be a signal corresponding to a brightness level according to an initial setting or a usage environment (e.g., an ambient illumination sensed by a light sensor), or may be a signal corresponding to a brightness level selected according to a user input.

In an embodiment, the controller 240 may supply gamma data VGAM corresponding to the input brightness selection signal SEL to the data driver 230. The gamma data VGAM may include gamma voltages set with respect to reference gray levels (e.g., predetermined reference gray levels).

For example, the controller 240 may output the gamma voltages of the reference gray levels according to the brightness level corresponding to the brightness selection signal SEL to the data driver 230. Then, the data driver 230 may generate data signals corresponding to the input image data DATA (or image data obtained by converting the input image data) using the gamma voltages of the reference gray levels, and supply the data signals to the data lines D1-Dm. Therefore, the brightness of the pixels PX may be controlled in accordance with the selected brightness level.

In addition, the controller 240 may gradually change a gate-off period of the light emission control signal, with respect to a brightness level of a range (e.g., a predetermined range) corresponding to the input brightness selection signal SEL, for example, brightness levels belonging to a low brightness region (e.g., a "low brightness section") equal to or less than a reference brightness level (e.g., a predetermined reference brightness level). For example, the controller 240 may adjust a pulse width of the light emission start signal according to a duty value (e.g., an on duty value of the light emission control signal corresponding to a time during which the pixels PX emit light) corresponding to the light emission time of the pixels PX set according to each brightness level with respect to brightness levels of the low brightness region, and may supply the adjusted light emission start signal to the light emission control driver 220 by including the adjusted light emission start signal in the second control signal CON2.

Then, the light emission control driver 220 may supply the light emission control signal having a pulse width corresponding to the duty value to the light emission control lines E1 to En in accordance with the second control signal CONT2. Therefore, the brightness of the display area 100 may be controlled based on the light emission time of the pixels PX.

For example, the light emission control driver 220 may receive the second control signal CONT2 corresponding to the duty value according to each brightness level and may supply the light emission control signal having the pulse width corresponding the duty value to the light emission control lines E1 to En in accordance with the second control signal CONT2. According to an embodiment, the light emission start signal included in the second control signal CONT2 may have a pulse width corresponding to the duty value associated with the selected brightness level (e.g., each brightness level being associated with a corresponding duty value). In this case, the light emission control driver 220 may sequentially shift the light emission start signal using the light emission clock signal to sequentially supply the light emission control signal having a pulse width corresponding to the pulse width of the light emission start signal to the light emission control lines E1 to En. Then, the pixels PX emit light for a time corresponding to the pulse width of the light emission control signal during each frame period. Therefore, the brightness of the display area 100 may be controlled according to the pulse width of the light emission control signal.

For example, the light emission control signal may have a pulse width corresponding to a duty value corresponding to the selected brightness level. According to an embodiment, the duty value may be set to an on duty value or an off duty value of the light emission control signal. The on duty value corresponds to a width of a period in which the light emission control signal has the gate-on voltage, and the off duty value corresponds to a width of a period in which the light emission control signal has the gate-off voltage. For example, as the on duty value of the light emission control signal increases, the off duty value of the light emission control signal may decrease. According to an embodiment, the on/off duty value of the light emission control signal may be set to a value for the number of horizontal periods during which the light emission control signal maintains the gate-on/off voltage, but is not limited thereto.

As the on duty value of the light emission control signal increases, the light emission time of each pixel PX increases. Therefore, the pixel PX receiving the light emission control signal emits light for a time longer than a corresponding frame period, thereby representing a relatively high brightness even for the same data signal.

On the other hand, as the off duty value of the light emission control signal increases, the light emission time of each pixel PX decreases. Therefore, the pixel PX receiving the light emission control signal emits light for a time shorter than a corresponding frame period, thereby representing a relatively low brightness even for the same data signal.

For example, the on/off duty value of the light emission control signal may correspond to an on/off duty value of the pixels PX. When the brightness is controlled by changing the on/off duty value of the light emission control signal as described above, the brightness of the display area 100 may be more effectively controlled even in the low brightness region in which the display area 100 is driven with a relatively low driving current.

In order to control the brightness of the display area 100 in accordance with the brightness selection signal SEL, the controller 240 may include a brightness controller 250. In addition, the display driver 200 may further include a storage unit for storing information necessary for an operation of the brightness controller 250. According to an embodiment, the storage unit may be included in the controller 240, but is not limited thereto.

The brightness controller 250 may divide brightness levels into a low brightness region (hereinafter, referred to as a "first brightness region") including brightness levels lower than the reference brightness level and a high brightness region (also referred to as a "high brightness section" and hereinafter referred to as a "second brightness region") including brightness levels higher than the reference brightness level, based on the reference brightness level (e.g., the predetermined reference brightness level), and may control the brightness of the display area 100 using different methods according to the brightness region to which each brightness level belongs. The reference brightness level may be considered to be included in the first brightness region or the second brightness region, or may be considered to be included in both the first brightness region and the second brightness region.

For example, the brightness controller 250 may divide brightness levels into the first brightness region and the second brightness region, based on a K-th (K is a natural number of two or more) sample brightness level among some brightness levels (hereinafter, referred to as "sample brightness levels") selected as samples from a plurality of selectable brightness levels. For example, the brightness controller 250 may divide a brightness region including brightness levels equal to or less than the K-th sample brightness level into the first brightness region, and divide a brightness region including the brightness levels equal to or greater than the K-th sample brightness level into the second brightness region. The brightness controller 250 may control the brightness of the display area 100 by executing a first brightness control mode in the first brightness region, may control the brightness of the display area 100 by executing a second brightness control mode in the second brightness region driven in a method different from that of the first brightness control mode.

For example, when the selected brightness level according to the brightness selection signal SEL is in the first brightness region, the brightness controller 250 may execute the first brightness control mode. In an embodiment, in the first brightness control mode, the brightness controller 250 may control the brightness of the display area 100 by adjusting the light emission time of the pixels PX and the gamma voltages of the reference gray levels according to the gamma data VGAM and the duty value (e.g., the on duty value of the light emission control signal) in accordance with the selected brightness level belonging to the first brightness region.

However, when the selected brightness level according to the brightness selection signal SEL is in to the second brightness region, the brightness controller 250 may execute the second brightness control mode. In an embodiment, in the second brightness control mode, the brightness controller 250 may control the brightness of the display area 100 by adjusting the gamma voltages of the reference gray levels according to the gamma data VGAM in accordance with the selected brightness level belonging to the second brightness region. In addition, in the second brightness control mode, the brightness controller 250 may maintain the light emission time of the pixels PX to be constant (e.g., a constant light emission time) regardless of each brightness level.

For convenience, in the following description, a duty value corresponding to each brightness level is set (e.g., selected or adjusted) based on the constant light emission time of the pixels PX applied in the second brightness control mode. For example, a case where the on duty value of the pixels PX is 100% (or the off duty value is 0%) at a certain brightness level may mean a case where the light emission time of the pixels PX is set to a maximum light emission time corresponding to the constant light emission time of the second brightness control mode. In addition, a case where the on duty value of the pixels PX is, for example, 90% (or the off duty value is 10%) at another brightness level may mean a case where the light emission time of the pixels PX is set to a light emission time corresponding to 90% of the maximum light emission time corresponding to the constant light emission time of the second brightness control mode.

As described above, the display device 10 according to an embodiment of the present disclosure divides the brightness regions based on the reference brightness level (e.g., the predetermined reference brightness level) (e.g., the K-th sample brightness level), and controls the brightness of the display area 100 using different methods according to each brightness region. For example, the display device 10 may control the brightness of the display area 100 through a gamma adjustment method that adjusts the gamma data VGAM according to the brightness level in the high brightness region including the brightness levels equal to or greater than the reference brightness level. In addition, the display device 10 may control the brightness of the display area 100 by applying a duty adjust method that adjusts the light emission time of the pixels PX together with the gamma adjustment method in the low brightness region corresponding to the brightness levels less than the reference brightness level (or equal to or less than the reference brightness level). Therefore, in terms of a brightness characteristic, power consumption, and the like of the display device 10, the brightness of the display area 100 may be efficiently and naturally (e.g., gradually or finely) controlled according to the brightness level.

Figure 2:
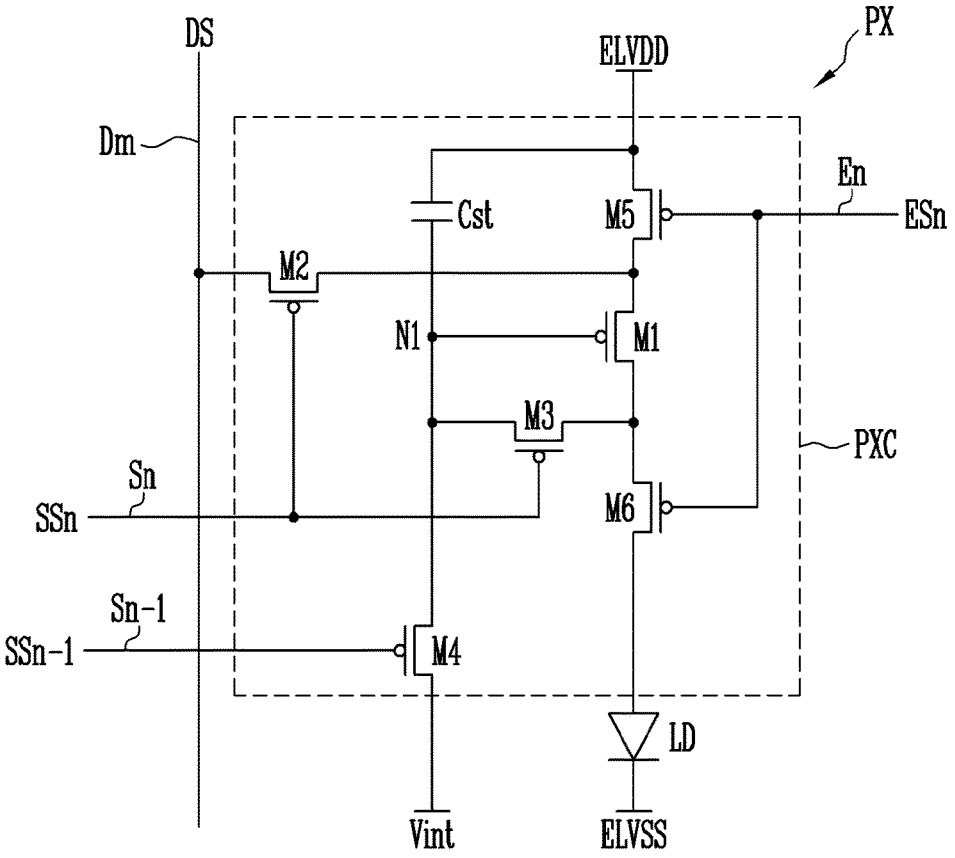
FIG. 2 is a circuit diagram illustrating a pixel according to an embodiment of the present disclosure.

FIG. 2 is a circuit diagram illustrating a pixel PX according to an embodiment of the present disclosure. According to an embodiment, the pixel PX shown in FIG. 2 may be any one of the pixels PX disposed in the display area 100 of FIG. 1. For example, the pixel PX shown in FIG. 2 may be a pixel disposed in an n-th (n is a natural number) horizontal line and an m-th (m is a natural number) vertical line of the display area 100, and the pixels PX of the display area 100 may have substantially the same or similar structure to each other.

Referring to FIG. 2, the pixel PX according to an embodiment of the present disclosure may include a light emitting element LD for generating light of a brightness corresponding to the data signal DS, and a pixel circuit PXC for controlling the light emitting element LD.

The first power source ELVDD and the second power source ELVSS may have different potentials. For example, the first power source ELVDD may be set as a high potential power source and the second power source ELVSS may be set as a low potential power source. A potential difference between the first power source ELVDD and the second power source ELVSS, for example, a voltage applied between the first power source ELVDD and the second power source ELVSS may be greater than a threshold voltage of the light emitting element LD, above which the light emitting element LD emits light.

The light emitting element LD may be connected between the first power source ELVDD and the second power source ELVSS. For example, one electrode (e.g., an anode electrode) of the light emitting element LD may be connected to the first power source ELVDD through the pixel circuit PXC, and the other electrode (for example, a cathode electrode) of the light emitting element LD may be connected to the second power source ELVSS. The light emitting element LD emits light at a brightness corresponding to a driving current supplied from the pixel circuit PXC.

According to an embodiment, the light emitting element LD may be an organic light emitting diode (OLED) including an organic light emitting layer, but is not limited thereto. For example, in another embodiment, ultra-small inorganic light emitting elements (e.g., as small as nano scale to micro scale) may serve as a light source unit of each pixel PX.

The pixel circuit PXC may be connected between the first power source ELVDD and the light emitting element LD. In addition, the pixel circuit PXC may be connected to a scan line of a corresponding horizontal line (or row), for example, at least one scan line including an n-th scan line (hereinafter, referred to as a "scan line" or a "current scan line") Sn, and a data line of a corresponding vertical line, for example, an m-th data line Dm (hereinafter, referred to as a "data line"). However, a position (e.g., the location or placement) of the pixel circuit PXC is not limited thereto. For example, in another embodiment, the pixel circuit PXC may be connected between the light emitting element LD and the second power source ELVSS. The pixel circuit PXC may generate a driving current corresponding to the data signal DS supplied from the data line Dm.

In an embodiment, the pixel circuit PXC may include first to sixth transistors M1 to M6 and a storage capacitor Cst. According to an embodiment, all of the first to sixth transistors M1 to M6 may be transistors of the same type. For example, in the embodiment shown in FIG. 2, all of the first to sixth transistors M1 to M6 may be P type transistors. In another embodiment, all of the first to sixth transistors M1 to M6 may be N type transistors. In some embodiments, at least one of the first to sixth transistors M1 to M6 may be P type transistors, and the remaining transistors may be N type transistors.

In an embodiment, the first transistor M1 is a driving transistor of each pixel PX and may be connected between the first power source ELVDD and the light emitting element LD. For example, the first transistor M1 may include a first electrode (e.g., a source electrode) connected to the first power source ELVDD through the fifth transistor M5, a second electrode (e.g., a drain electrode) connected to the light emitting element LD through the sixth transistor M6, and a third electrode (e.g., a gate electrode) connected to a first node N1. The first transistor M1 may generate a driving current corresponding to the data signal DS supplied to the first node N1 through the data line Dm.

The second transistor M2 may be connected between the data line Dm and the first electrode of the first transistor M1, and a gate electrode of the second transistor M2 may be connected to the scan line Sn. The second transistor M2 may be turned on when a scan signal SSn having a gate-on voltage (also referred to as a "current scan signal") is supplied from the scan line Sn. When the second transistor M2 is turned on, the data signal DS supplied to the data line Dm may be transferred to the first electrode of the first transistor M1.

The third transistor M3 may be connected between the second electrode of the first transistor M1 and the first node N1, and a gate electrode of the third transistor M3 may be connected to the scan line Sn. The third transistor M3 may be turned on when the scan signal SSn having the gate-on voltage is supplied from the scan line Sn. When the third transistor M3 is turned on, the first transistor M1 is connected in a diode form (e.g., diode-connected).

The fourth transistor M4 may be connected between the first node N1 and an initialization power source Vint, and a gate electrode of the fourth transistor M4 may be connected to an initialization control line of a corresponding horizontal line. The initialization control line may be, for example, a current scan line of an immediately previous (e.g., immediately preceding) horizontal line, for example, an (n−1)-th scan line Sn−1 (hereinafter, referred to as a "previous scan line"). However, the present disclosure is not limited thereto. For example, in another embodiment, initialization control lines, separate from the scan lines, may be provided. The fourth transistor M4 may be turned on when a previous scan signal SSn−1 having a gate-on voltage is supplied to the previous scan line Sn−1. When the fourth transistor M4 is turned on, the first node N1 is initialized to a voltage of the initialization power source Vint. According to an embodiment, the voltage of the initialization power source Vint may be less than or equal to the lowest voltage of the data signal DS. For example, the voltage of the initialization power source Vint may be lower than the lowest voltage of the data signal DS by at least a threshold voltage of the first transistor M1. Therefore, the data signal DS may be stably (e.g., reliably or repeatably) supplied to the first node N1 during each frame period regardless of the voltage of the data signal DS supplied in a previous frame period.

The fifth transistor M5 may be connected between the first power source ELVDD and the first electrode of the first transistor M1, and a gate electrode of the fifth transistor M5 may be connected to a light emission control line of a corresponding horizontal line (or corresponding row), for example, an n-th light emission control line En (hereinafter, referred to as a "light emission control line"). The fifth transistor M5 may be turned off when a light emission control signal ESn having a gate-off voltage is supplied to the light emission control line En, and may be turned on in other cases (e.g., when a voltage of the light emission control signal ESn is a gate-on voltage). When the fifth transistor M5 is turned off, a connection between the first power source ELVDD and the first transistor M1 may be cut off (or disconnected), and when the fifth transistor M5 is turned on, the first transistor M1 may be connected to the first power source ELVDD.

The sixth transistor M6 may be connected between the second electrode of the first transistor M1 and the light emitting element LD, and a gate electrode of the sixth transistor M6 may be connected to the light emission control line En. The sixth transistor M6 may be turned off when the light emission control signal ESn having the gate-off voltage is supplied to the light emission control line En, and may be turned on in other cases (e.g., when the voltage of the light emission control signal ESn is the gate-on voltage). When the sixth transistor M6 is turned off, the connection between the first transistor M1 and the light emitting element LD may be cut off, and when the sixth transistor M6 is turned on, the first transistor M1 may be connected to the light emitting element LD.

The fifth and sixth transistors M5 and M6 may be light emission control transistors that control light emission of each pixel PX. A current path through which a driving current may flow may be formed according to whether the fifth and sixth transistors M5 and M6 are on or off. Therefore, the light emission time of each pixel PX may be controlled by adjusting a pulse width of the light emission control signal ESn controlling whether the fifth and sixth transistors M5 and M6 are on or off.

The storage capacitor Cst may be connected between the first power source ELVDD and the first node N1. The storage capacitor Cst may store a voltage corresponding to the threshold voltage of the first transistor M1 and the data signal DS transferred to the first node N1 during each frame period (e.g., during a data programming period of each frame).

However, the structure of the pixel circuit PXC is not limited to the embodiment shown in FIG. 2. For example, in another embodiment, the pixel circuit PXC may include only some of the first to sixth transistors M1 to M6. For example, the pixel circuit PXC may include only the first and second transistors M1 and M2 and the fifth and/or sixth transistors M5 and/or M6 among the first to sixth transistors M1 to M6. In some embodiments, the pixel circuit PXC may further include at least one transistor in addition to the first to sixth transistors M1 to M6. For example, the pixel circuit PXC may further include a transistor connected between the anode electrode of the light emitting element LD and the initialization power source Vint and turned on when the scan signal (or another control signal) of the gate-on voltage is supplied from the scan line Sn (or another control line) to initialize an anode voltage of the light emitting element LD. In addition, the pixel circuit PXC may have various currently known structures.

Figure 3:
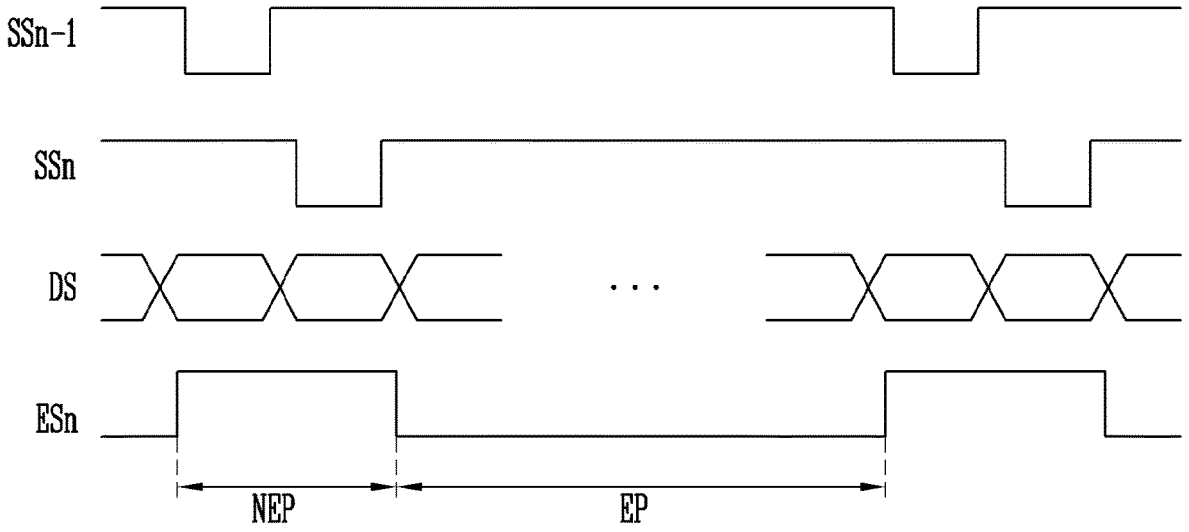
FIG. 3 is a waveform diagram illustrating an embodiment of driving signals input to the pixel of FIG. 2.

FIG. 3 is a waveform diagram illustrating an embodiment of driving signals input to the pixel PX of FIG. 2. For example, FIG. 3 illustrates example waveforms of the previous scan signal SSn−1, the current scan signal SSn, the data signal DS, and the light emission control signal ESn supplied to the previous scan line Sn−1, the current scan line Sn, the data line Dm, and the light emission control line En connected to the pixel PX of FIG. 2. The previous scan signal SSn−1, the current scan signal SSn, the data signal DS, and the light emission control signal ESn may be supplied to the pixels PX in a frame period.

Referring to FIGS. 2 and 3, first, the previous scan signal SSn−1 having a gate-on voltage (e.g., a low level voltage) is supplied through the previous scan line Sn−1 during an initialization period of the pixel PX. Accordingly, the fourth transistor M4 may be turned on and a voltage of the first node N1 may be initialized to the voltage of the initialization power source Vint.

Thereafter, the current scan signal SSn having a gate-on voltage (e.g., a low level voltage) is supplied through the current scan line Sn during a data programming period of the pixel PX. Accordingly, the second and third transistors M2 and M3 may be turned on. When the third transistor M3 is turned on, the first transistor M1 may be connected in the diode form (e.g., diode-connected). When the second transistor M2 is turned on, the first node N1 is connected to the data line Dm and thus the data signal DS supplied to the data line Dm is transferred to the first node N1 through the second transistor M2, the first transistor M1, and the third transistor M3 sequentially. Accordingly, a voltage corresponding to the data signal DS and the threshold voltage of the first transistor M1 (e.g., a voltage corresponding to the difference between the voltage of the data signal DS and the threshold voltage of the first transistor M1) is supplied to the node N1. The voltage supplied to the first node N1 is stored in the storage capacitor Cst.

During the initialization period and the data programming period in which the previous scan signal SSn−1 and the current scan signal SSn having the gate-on voltage are supplied, the light emission control signal ESn having a gate-off voltage (e.g., a high level voltage) may be supplied to the light emission control line En. Accordingly, the fifth and sixth transistors M5 and M6 may be turned off during the initialization period and the data programming period to prevent (e.g., reduce or mitigate) unintended light emission from the pixel PX.

Thereafter, during a light emission period EP of the pixel PX, a voltage of the light emission control signal ESn may be changed to a gate-on voltage (e.g., a low level voltage). Accordingly, the fifth and sixth transistors M5 and M6 may be turned on, and a current path may be formed from the first power source ELVDD to the second power source ELVSS through the fifth transistor M5, the first transistor M1, the sixth transistor M6, and the light emitting element LD sequentially.

During the light emission period EP, a driving current corresponding to the voltage of the first node N1 may be generated by the first transistor M1, and the driving current may flow through the current path formed in the pixel PX. Therefore, the light emitting element LD may emit light at the brightness corresponding to the data signal DS.

Because a voltage obtained by subtracting the threshold voltage of the first transistor M1 from the voltage of the data signal DS is transferred to the first node N1 during a previous data programming period, the threshold voltage of the first transistor M1 may be offset during the light emission period EP. Therefore, the pixel PX may uniformly emit light at the brightness corresponding to the data signal DS regardless of the threshold voltage of the first transistor M1.

In the pixel PX and the driving method thereof described with reference to FIGS. 2 and 3, a current path is formed in accordance with the light emission control signal ESn. Therefore, the light emission time of each pixel PX may be controlled by adjusting the pulse width of the light emission control signal ESn.

For example, a period in which the light emission control signal ESn has a gate-off voltage (e.g., a period including the initialization period and the data programming period) may be set to a non-emission period NEP of the pixel PX, and a period in which the light emission control signal ESn has a gate-on voltage may be set to the light emission period EP of the pixel PX. Therefore, when a gate-off voltage period of the light emission control signal ESn is increased, an amount of light emitted by the pixel PX may decrease while the non-emission period NEP of each pixel PX increases. Thus, an effective (e.g., perceived) brightness of the pixel PX may be reduced. On the other hand, when the gate-on voltage period of the light emission control signal ESn is increased, the amount of light emitted by the pixel PX may increase while the light emission period EP of each pixel PX increases. Thus, an effective (e.g., perceived) brightness of the pixel PX may be increased.

Figure 4:
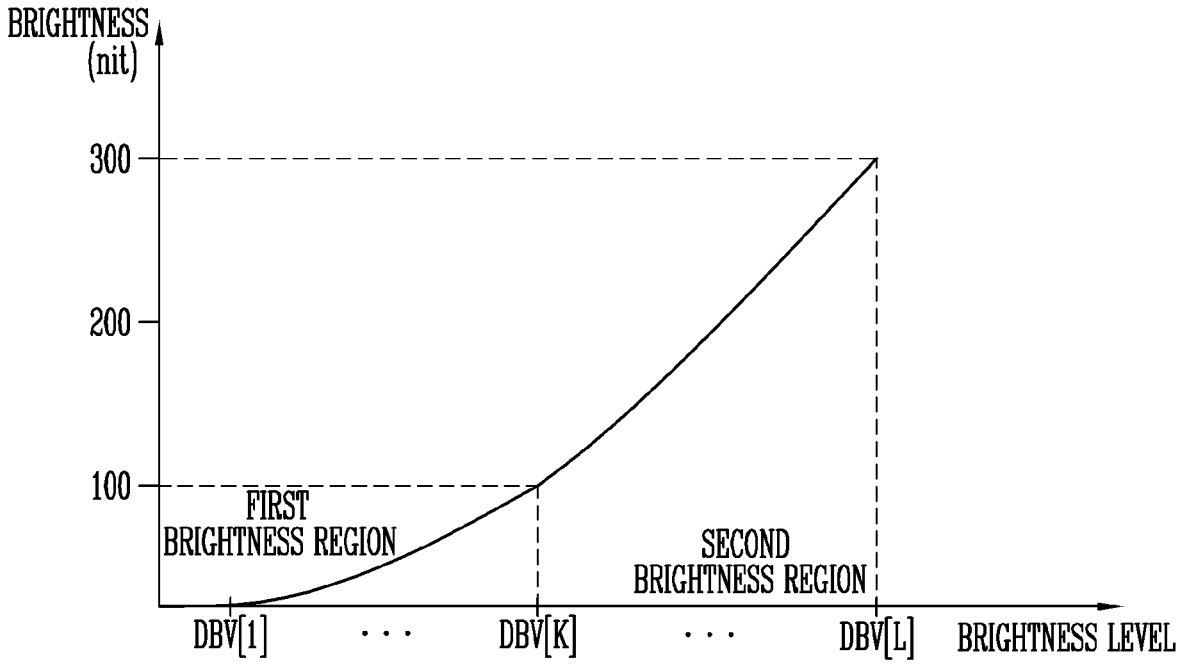
FIG. 4 is a graph illustrating a brightness change in accordance with a brightness level, according to an embodiment of the present disclosure.
Figure 5:
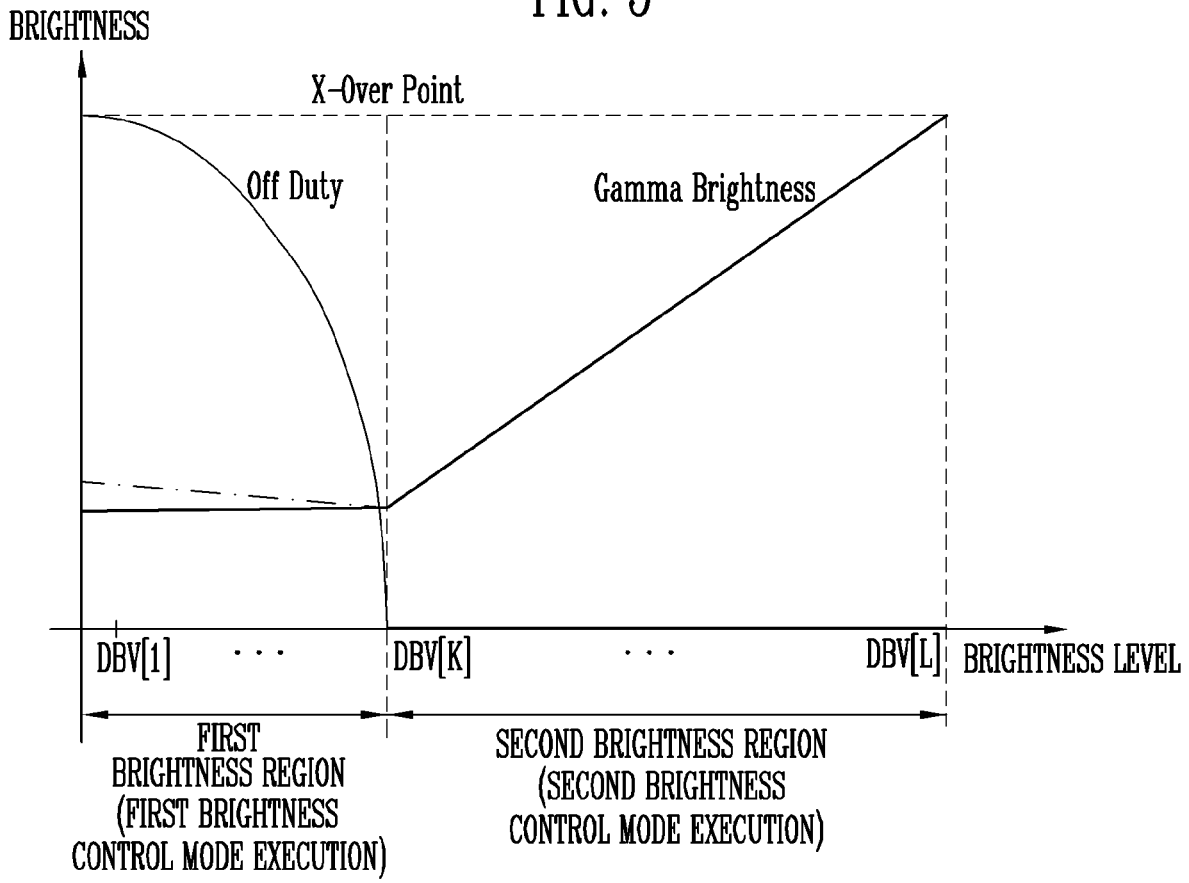
FIG. 5 is a graph illustrating a method of controlling a brightness of the display device according to an embodiment of the present disclosure.
Figure 6:
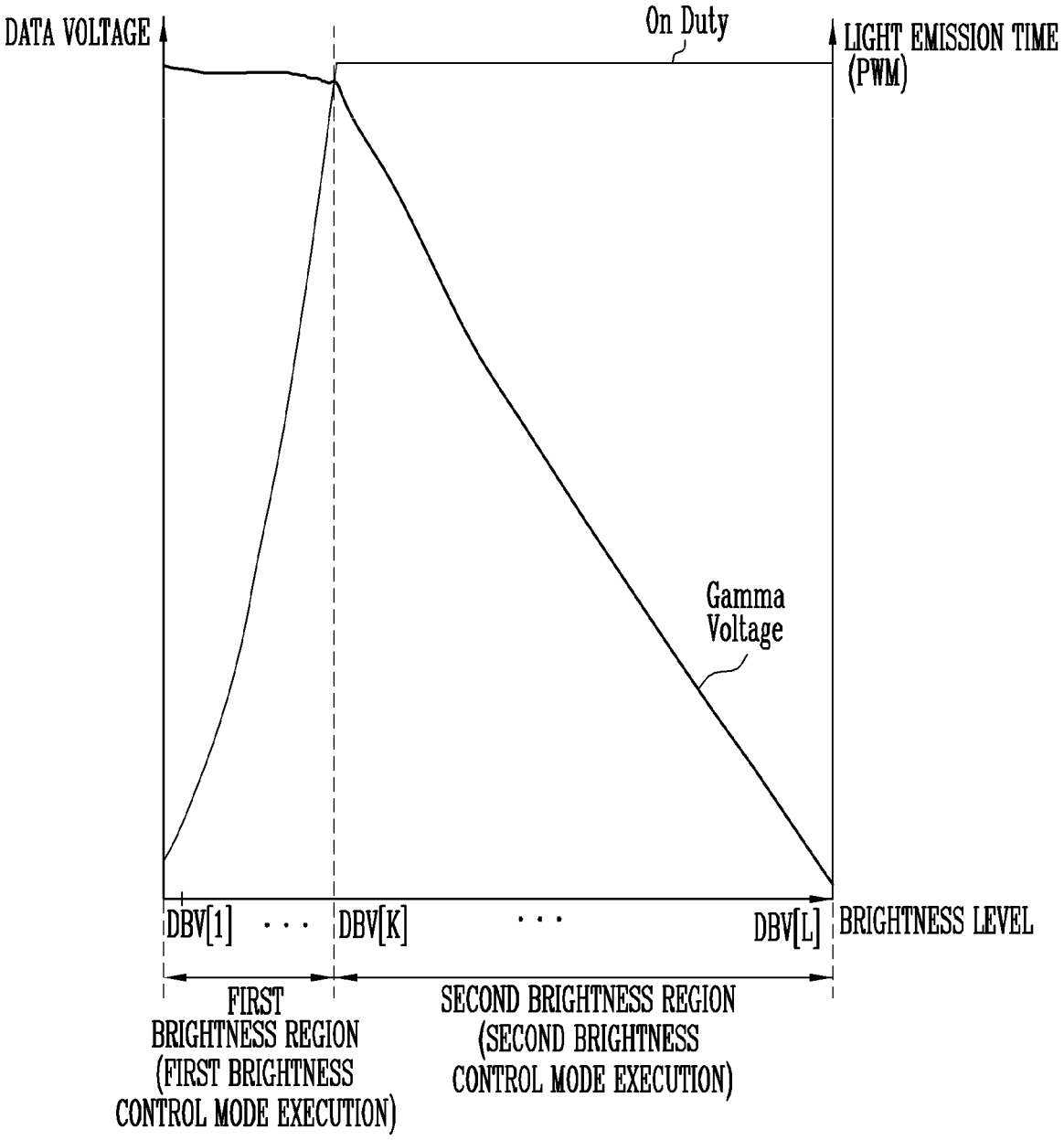
FIG. 6 is a graph illustrating a change of a data voltage and a light emission time in accordance with a brightness level, according to an embodiment of the present disclosure.

FIG. 4 is a graph illustrating a brightness change according to a brightness level, according to an embodiment of the present disclosure. For example, FIG. 4 illustrates a maximum brightness set at each brightness level according to an embodiment of the present disclosure. FIG. 5 is a graph illustrating a method of controlling a brightness of the display device 10 according to an embodiment of the present disclosure. FIG. 6 is a graph illustrating a change of the data voltage and the light emission time according to a brightness level, according to an embodiment of the present disclosure.

First, referring to FIGS. 1 to 4, a maximum brightness for each brightness level may be set so that the brightness of the display area 100 gradually increases as the brightness level increases. According to an embodiment, the maximum brightness for each brightness level may be set so that a natural brightness change may be recognized according to the brightness level in accordance with a human visibility characteristic (e.g., changes in the brightness level are human-perceptible changes).

In an embodiment, instead of storing gamma data VGAM for all selectable brightness levels, gamma data VGMA (also referred to as "reference gamma data") for each of some sample brightness levels DBV[1] to DBV[L] (e.g., L (where Lisa natural number of two or more) multi time programming (MTP) tap points) may be set and stored, and gamma data VGMA for a corresponding brightness level may be acquired through gamma interpolation with respect to the remaining brightness levels. Here, the gamma data VGAM corresponding to each brightness level may include gamma voltages set for reference gray levels (e.g., predetermined reference gray levels) with respect to a corresponding brightness level. For example, the gamma data VGAM corresponding to each brightness level may include gamma voltages for outputting a data voltage corresponding to each reference gray level at a corresponding brightness level.

For example, when any one of the sample brightness levels is selected, the gamma voltages for the reference gray levels stored with respect to the selected sample brightness level may be output to the data driver 230 as the gamma data VGAM. When any one of the remaining brightness levels for which the gamma data VGAM is not stored in advance is selected, a gamma voltage for each reference gray level corresponding to a corresponding brightness level may be calculated through the gamma interpolation, and the calculated gamma voltages may be output to the data driver 230 as the gamma data VGAM. Therefore, in the data driver 230, data signals DS having voltages corresponding to respective brightness levels may be generated.

Then, the data driver 230 may generate the data signal DS corresponding to the image data DATA by using the gamma voltages supplied from the brightness controller 250 and supply the data signal DS to the pixels PX. Therefore, the brightness of the display area 100 may be controlled as a whole in accordance with each brightness level.

According to an embodiment, the display device 10 may store the gamma data VGAM according to an optical compensation process implemented with respect to each sample brightness level. For example, the controller 240 may include a storage unit (e.g., memory) in which the gamma data VGAM for each sample brightness level is stored (e.g., a plurality of sets of gamma data VGAM are stored in the storage unit, each of the sample brightness levels corresponding to one of the sets of gamma data).

The optical compensation process refers to a deviation correction process for setting a gamma curve for maintaining stable display quality as a correlation between a display brightness and a gray level. In order to eliminate or reduce a deviation between the display brightness according to the gray level (e.g., a target brightness for each gray level) and an actual display brightness, correction for the gamma data VGAM (e.g., the gamma voltages for the reference gray levels of each sample brightness level) corresponding to each sample brightness level may be repeatedly implemented. The optical compensation process may be a multi time programming (MTP) process that repeatedly performs correction for the gamma data VGAM corresponding to each sample brightness level, but is not limited thereto.

According to an embodiment, as described above, the first brightness region and the second brightness region may be divided based on the reference brightness level (e.g., the predetermined reference brightness level), and the brightness of the display area 100 may be controlled according to different methods for each brightness region. The reference brightness level may be a specific sample brightness level used as a reference for dividing the first brightness region and the second brightness region among a plurality of sample brightness levels. For example, in describing an embodiment of the present disclosure, the sample brightness level, which is the reference for dividing the brightness region, is distinguished from the remaining sample brightness levels and referred to as a "reference brightness level".

For example, when a K-th sample brightness level DBV [K] having a maximum brightness of 100 nits is set as the reference brightness level, the brightness region of which a maximum brightness is less than 100 nit (or the maximum brightness is less than or equal to 100 nits) may be referred to as the first region, and the brightness of the display area 100 may be controlled according to the first brightness control mode. In addition, a brightness region, for which a maximum brightness is greater than 100 nits (for example, a brightness region from the K-th sample brightness level DBV[K] to an L-th sample brightness level DBV[L] when a maximum set brightness of the display device 10 is 300 nits and the brightness level corresponding thereto is an L-th (L is a natural number greater than K) brightness level), may be referred to as the second brightness region, and the brightness of the display area 100 may be controlled according to the second brightness control mode.

Referring to FIGS. 1 to 5, in the first brightness region, the first brightness control mode may be executed. In the first brightness control mode, as the brightness level increases, the brightness of the display area 100 may be increased by decreasing the off duty value (e.g., increasing the on duty value). The off duty value corresponds to a length of a gate-off voltage period of the light emission control signal ESn according to each brightness level, and may correspond to a non-light emission time of the pixels PX. The first brightness control mode may be an active-matrix organic-light emitting diode (AMOLED) impulsive driving (AID) mode (e.g., a "pulse width modulation (PWM) mode") driven using the duty adjustment method as a main brightness control means.

In an embodiment, in order to execute the first brightness control mode, an on/off duty value (e.g., an on duty value and/or an off duty value of the light emission control signal ESn according to each sample brightness level) for each of the sample brightness levels of the first brightness region may be set and stored, and an on/off duty value (an on duty value and/or an off duty value of the light emission control signal ESn for each of the remaining brightness levels) may be calculated through duty interpolation with respect to the remaining brightness levels of the first brightness region. In some embodiments, a plurality of brightness level groups may be configured to include each sample brightness level, and the on/off duty value may be differentially set for each brightness level group.

According to an embodiment, the duty adjustment method and the gamma adjustment method may be applied together in the first brightness region. For example, in the first brightness control mode, the duty adjustment method may provide a main brightness control, and the gamma adjustment method may provide an auxiliary brightness control.

For example, color coordinate distortion may occur due to duty adjustment at each brightness level, and therefore the gamma data VGAM corresponding to the brightness level may be finely controlled (e.g., by increasing or decreasing the gamma voltage for at least one reference gray level to change the gamma brightness) to correct the color coordinate. Therefore, the brightness of the display area 100 may be more precisely controlled and image quality may be improved even in the first brightness region where the driving current is relatively low.

In the second brightness region, the gamma data VGAM may be controlled such that the gamma brightness increases as the brightness level increases according to the second brightness control mode. For example, the second brightness control mode may be a gamma mode driven by a gamma adjustment method.

In the second brightness region, the on/off duty value may be maintained to be constant (e.g., held constant). For example, in the second brightness region, the on/off duty value of the light emission control signal ESn may be constant regardless of the brightness level.

Referring to FIGS. 1 to 6, in the first brightness region, as the brightness level increases according to the first brightness control mode, the brightness of the display area 100 may be increased by increasing the on duty value. The on duty value corresponds to the length of the gate-on voltage period of the light emission control signal ESn according to each brightness level and may correspond to the light emission time of the pixels PX. In the first brightness control mode, the brightness of the display area 100 may be controlled by controlling the light emission time of the pixels PX through a PWM method of adjusting the pulse width of the light emission control signal ESn.

In addition, in the first brightness control mode, the data voltage may also be controlled according to each brightness level. For example, when a color coordinate is distorted due to duty adjustment according to each brightness level in the first brightness control mode, a gamma voltage for at least one reference gray level may be controlled in accordance with the brightness level to correct the color coordinate distortion. Therefore, the image quality of the image displayed in the display area 100 may be improved.

In the second brightness region, the data voltage may be controlled such that the brightness of the display area 100 increases as the brightness level increases. For example, as the embodiment of FIG. 2, when each pixel PX includes a P type driving transistor (e.g., the first transistor M1), as the brightness level increases, the gamma voltage for each reference gray level may be decreased to increase a current amount (e.g., a magnitude) of the driving current flowing through each pixel PX.

In the second brightness region, the on duty value may be maintained to be constant (e.g., held constant) regardless of the brightness level. For example, in the second brightness region, the on duty value of the light emission control signal ESn according to each brightness level may be maintained to be constant at 100% according to a maximum value (e.g., a predetermined maximum value). Therefore, the pixels PX may emit light at a brightness corresponding to the data signal for a maximum light emission time (e.g., a predetermined maximum light emission time) during each frame period, in accordance with each brightness level of the second brightness region.

In an embodiment, each gamma data VGAM and/or on/off duty value may be calculated through linear interpolation with respect to sample brightness levels, for example, brightness levels between the first to L-th sample brightness levels DBV[1] to DBV[L]. For example, each gamma data VGAM and/or on/off duty value may be calculated through linear interpolation with respect to the remaining brightness levels except for the sample brightness levels among the selectable brightness levels, for example, intermediate brightness levels for which the gamma data VGAM for the reference gray levels and/or on/off duty value is not stored.

According to an embodiment, the sample brightness levels may be specific brightness levels for which the gamma data VGAM is stored, which may be the same as or different from the specific brightness levels for which each on/off duty value is stored. For example, the display device 10 may store the gamma data VGAM for each of the first to L-th sample brightness levels DBV[1] to DBV[L], and may calculate the gamma data VGAM for the remaining brightness levels using the gamma data VGAM for each of the first to L-th sample brightness levels DBV[1] to DBV[L].

In addition, the display device 10 may store an on duty value (or an off duty value) for each of the sample brightness levels. In addition, according to an embodiment, the display device 10 may further store an on duty value (or an off duty value) set for a specific brightness level in addition to the sample brightness levels. For example, in the first brightness region, to which the duty adjustment method is applied, the display device 10 may include a duty tap point for the duty adjustment in addition to the sample brightness levels belonging to the first brightness region. Therefore, the on duty value may be more precisely controlled in the first brightness region to which the duty adjustment method is applied.

Figure 7:
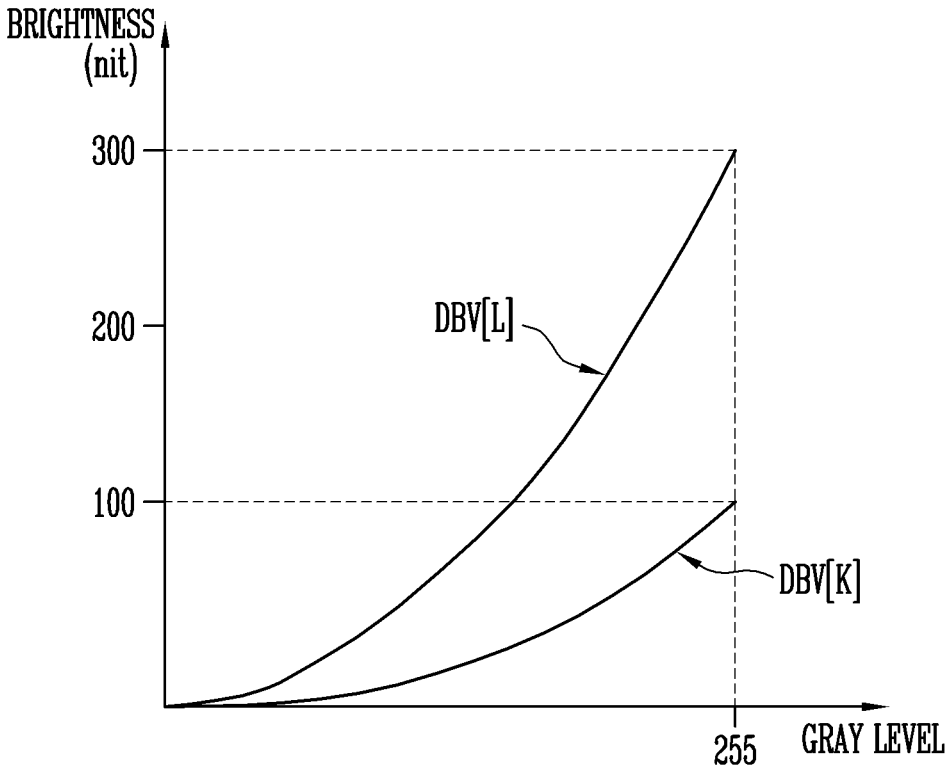
FIG. 7 is a graph illustrating a brightness difference between brightness levels of a second brightness region according to an embodiment of the present disclosure.

FIG. 7 is a graph illustrating a brightness difference between brightness levels of the second brightness region according to an embodiment of the present disclosure. For example, FIG. 7 illustrates a brightness change according to the gray level at the lowest brightness level and the highest brightness level of the second brightness region.

Referring to FIGS. 4 to 7, the lowest brightness level of the second brightness region may be the reference brightness level positioned at a boundary between the first and second brightness regions, for example, the K-th sample brightness level DBV[K]. In addition, the highest brightness level of the second brightness region may be the L-th sample brightness level DBV[L] which is a last sample brightness level of the second brightness region.

In an embodiment, when the maximum set brightness of the display device 10 is 300 nits, the brightness corresponding to the highest gray level, for example, gray level 255, may be set to 300 nits in the L-th sample brightness level DBV[L]. In addition, in the K-th sample brightness level DBV[K], a brightness corresponding to gray level 255 may be set to a brightness lower than 300 nits, for example, 100 nits. In addition, in each of the L-th sample brightness level DBV[L] and the K-th sample brightness level DBV[K], each target brightness may be set according to a desired gamma curve with respect to reference gray levels (e.g., predetermined reference gray levels), for example, gray levels 66, 100, and 155, in addition to the highest gray level.

According to an embodiment, in the second brightness region, the gamma data VGAM may be set with respect to each of the sample brightness levels DBV[K] to DBV[L] such that the target brightness is expressed at each reference gray level. In addition, the gamma data VGAM for the reference gray levels may be acquired through the gamma interpolation with respect to other brightness levels between the sample brightness levels DBV[K] to DBV[L]. For example, in the second brightness region, the brightness of the display area 100 may be controlled through the gamma adjustment method, thereby obtaining a maximum brightness and a gamma curve corresponding thereto with respect to each brightness level.

Figure 8:
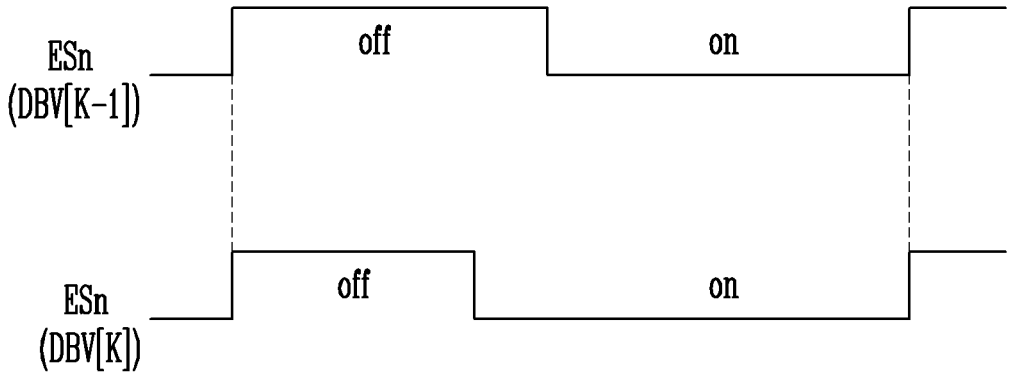
FIG. 8 is a waveform diagram of a light emission control signal illustrating a duty adjustment method applied to a first brightness region according to an embodiment of the present disclosure.

FIG. 8 is a waveform diagram of the light emission control signal ESn illustrating the duty adjustment method applied to the first brightness region according to an embodiment of the present disclosure. According to an embodiment, with reference to FIG. 8, the duty adjustment method is described by comparing a light emission control signal ESn generated at a sample brightness level lower than the reference brightness level by one stage (or one brightness level), for example the (K−1)-th sample brightness level DBV[K−1] as a brightness level belonging to the first brightness region with a light emission control signal ESn generated at the reference brightness level, for example, the K-th sample brightness level DBV[K].

Referring to FIGS. 4 to 8, in the first brightness region, the brightness of the display area 100 may be controlled by differentially setting an on/off duty ratio of the light emission control signal ESn according to each brightness level. For example, an off duty value of the light emission control signal ESn corresponding to the (K−1)-th sample brightness level DBV[K−1] may be set larger than an off duty value of the light emission control signal ESn corresponding to the K-th sample brightness level DBV[K].

As the off duty value of the light emission control signal ESn increases, an on duty value of the light emission control signal ESn decreases. For example, the on duty value of the light emission control signal ESn at the (K−1)-th sample brightness level DBV[K−1] may be set smaller than the on duty value of the light emission control signal at the K-th sample brightness level DBV[K]. Therefore, in the (K−1)-th sample brightness level DBV[K−1], the light emission time of the pixels PX decreases in accordance with the increase of the off duty value, and thus the brightness of the pixels PX may be reduced as a whole in comparison with in the K-th sample brightness level DBV[K].

Figure 9:
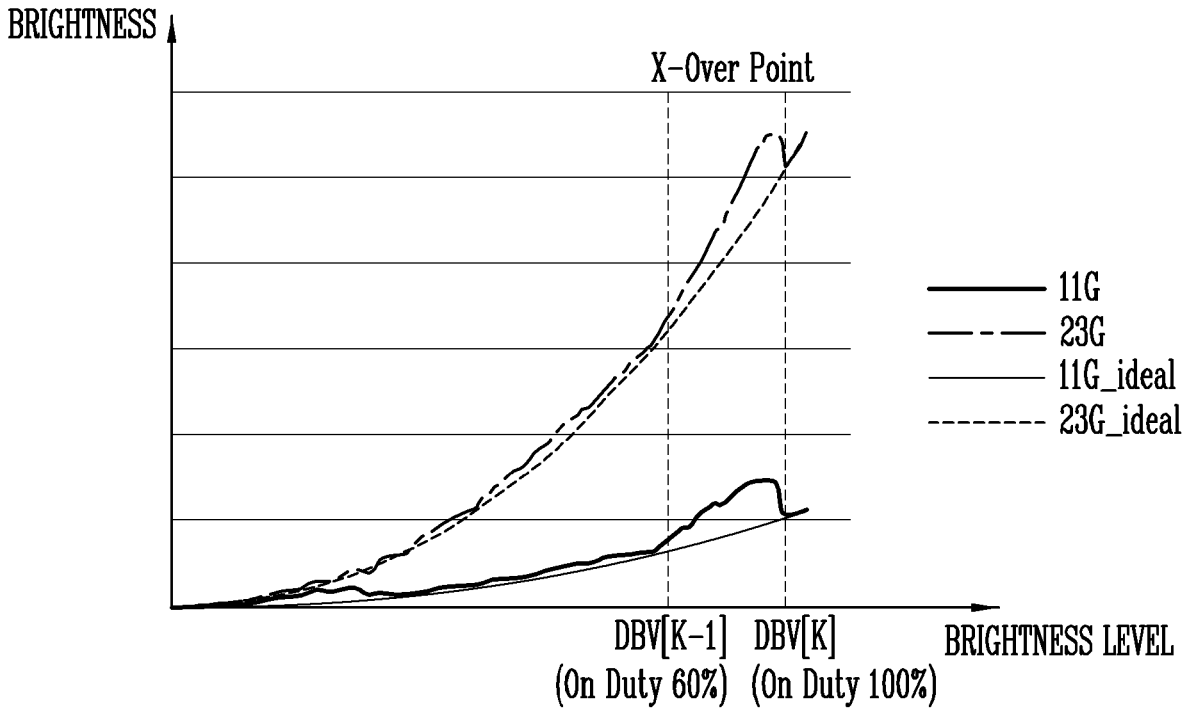
FIG. 9 is a graph illustrating a deviation between an actual brightness measured in the first brightness region and a target brightness according to sample brightness levels of the first brightness region according to an embodiment of the present disclosure.

FIG. 9 is a graph illustrating a deviation between an actual brightness measured in the first brightness region and a target brightness according to the sample brightness levels of the first brightness region according to an embodiment of the present disclosure.

Referring to FIGS. 4 to 9, each of the sample brightness levels may be set at points corresponding to different on duty values in the first brightness region. For example, K−1 sample brightness levels may be included in the first brightness region. When the first brightness region includes the reference brightness level used for the gamma and/or duty interpolation in the first brightness region, for example, the K-th sample brightness level DBV[K] together with the K−1 sample brightness levels, the first brightness region may include K sample brightness levels.

In an embodiment, the sample brightness levels of the first brightness region may be disposed (e.g., spaced apart) at an interval (e.g., a predetermined interval) or more in consideration of a memory capacity, efficiency of an optical compensation process, and the like. For example, the sample brightness levels of the first brightness region may be distributed and positioned at points at which the on duty values (e.g., light emission duty values) corresponding to each brightness level are different from each other by at least 10% or more. In addition, because the driving current decreases as the brightness level decreases, the sample brightness levels may be disposed in the first brightness region in consideration of more precise correction of the on duty value and/or gamma data VGAM.

For example, in the first brightness region, four sample brightness levels may be disposed at points where on duty values including the reference brightness level are set to 15%, 30%, 60%, and 100%, respectively, and the on duty value and/or gamma data VGAM set with respect to each of the sample brightness levels may be interpolated to calculate the duty value and/or gamma data VGAM for the remaining brightness levels of the first brightness region. In this case, the (K−1)-th sample brightness level DBV[K−1] may be disposed at a point where the on-duty value is set to 60%, and the K-th sample brightness level DBV[K] may be disposed at a point where the on-duty value is set to 100%.

In describing an embodiment of the present disclosure, the "on duty value" may be based on the on duty value of brightness levels of the second brightness region (e.g., the constant on duty value of the brightness levels of the second duty region). For example, the "on duty value" may be based on a maximum light emission time that may be set with respect to each pixel PX, or a length of a gate-on voltage period of the light emission control signal ESn corresponding to the maximum light emission time. For example, "on duty value is 100%" means that the on duty value is the same as the constant on duty value of brightness levels of the second brightness region, and "on duty value is 60%" means that the on duty value has an on duty value corresponding to about 60% in comparison with the on duty value of the second brightness region.

As in the above-described embodiment, as a result of disposing the four sample brightness levels at the points at which the on duty values are 15%, 30%, 60%, and 100%, respectively and measuring the actual brightness displayed in the first brightness region, a brightness reversal phenomenon may occur between last interpolation sections (e.g., the (K−1)-th sample brightness level DBV[K−1] and the K-th sample brightness level DBV[K] for which the respective on duty values are 60% and 100%, respectively). The brightness reversal phenomenon may occur in the low brightness region for which the driving current is low. For example, as a result of measuring a change of the actual brightness according to each brightness level of the first brightness region with respect to each of gray level 11 (e.g., 11G) and gray level 23 (e.g., 23G) of a low gray level range, the actual brightness is measured higher than the target brightness between the (K−1)-th sample brightness level DBV[K−1] and the K-th sample brightness level DBV[K] (e.g., the last interpolation section of the first brightness region), and a deviation between the actual brightness and the target brightness may be most severe at a point close to the K-th sample brightness level DBV[K]. In the K-th sample brightness level DBV[K], because the gamma data VGAM is set to represent a target brightness (e.g., a predetermined target brightness) according to the optical compensation process such as the MTP process, the actual brightness measured at the K-th sample brightness level DBV[K] may be the desired target brightness or a brightness close thereto.

The above-described brightness reversal phenomenon may be more severe as an interval between the last interpolation sections of the first brightness region, for example, the reference brightness level (the K-th sample brightness level DBV[K]) and the immediately preceding sample brightness level (the (K−1)-th sample brightness level DBV[K−1]) increases. Due to the brightness reversal phenomenon, natural (e.g., monotonic) brightness adjustment may become difficult in the first brightness region, and an image quality characteristic of the display device 10 may be degraded.

Figure 10:
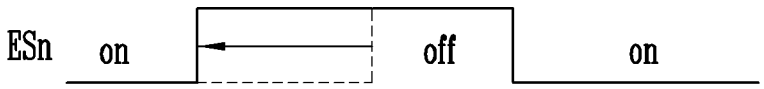
FIG. 10 is a waveform diagram of the light emission control signal for illustrating a brightness reversal phenomenon of FIG. 9.

FIG. 10 is a waveform diagram of the light emission control signal ESn for illustrating the brightness reversal phenomenon of FIG. 9. In addition, FIG. 11 is a graph of an on/off characteristic of a transistor (e.g., the driving transistor of the pixel PX) for illustrating the brightness reversal phenomenon of FIG. 9.

Figure 11:
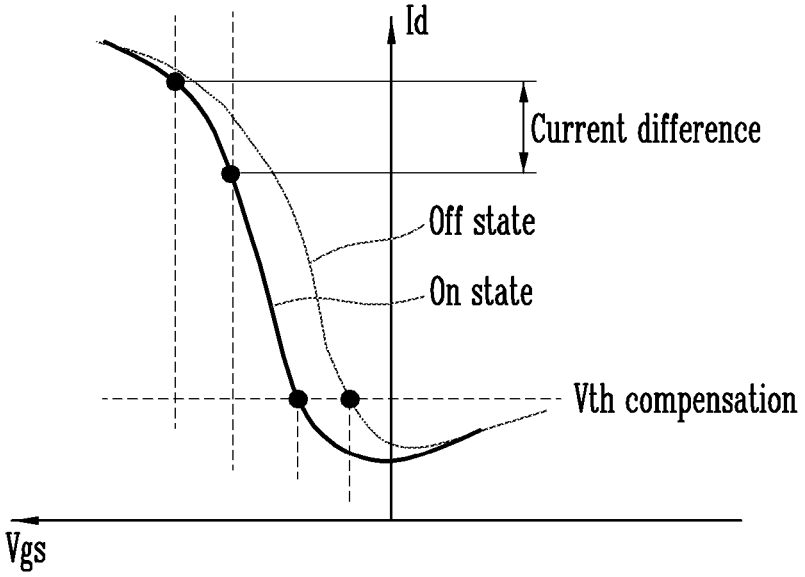
FIG. 11 is a graph of an on/off characteristic of a transistor for illustrating the brightness reversal phenomenon of FIG. 9.

Referring to FIGS. 9 to 11, as the off duty value of the light emission control signal ESn (e.g., the length of the gate-off voltage period of the light emission control signal ESn) increases, an off bias of the driving transistor (e.g., the first transistor M1 of FIG. 2) increases, and thus the driving current flowing through the pixel PX increases. For example, the driving transistor may have a different threshold voltage Vth in the on/off state (e.g., the on and off states), and as an off period increases, a deviation of the threshold voltage Vth may become more severe. Therefore, as the off duty value of the light emission control signal ESn increases, the driving current of the pixel PX increases. Thus, as the brightness level decreases, the brightness reversal phenomenon may occur due to the increase of the off bias of the driving transistor around the K-th sample brightness level DBV[K] where the off duty value of the light emission control signal ESn starts to increase.

For example, the brightness reversal phenomenon may occur in a brightness level range in which a difference between duty values is positioned within about 10% from the K-th sample brightness level DBV[K]. For example, the brightness reversal may occur between the brightness level at which the on duty value is set to 95% and the K-th sample brightness level DBV[K] at which the on duty value is set to100%.

In the remaining sections of the first brightness region (e.g., in a brightness level range in which the on duty value is set to 90% or less), the brightness may decrease due to the decreased light emission time of the pixels PX, rather than increasing due to the off bias of the driving transistor increasing. Therefore, as the brightness level decreases, the actual brightness may also decrease. For example, the brightness reversal phenomenon according to the off bias increase of the driving transistor may occur around a boundary between the first brightness region and the second brightness region, e.g., brightness levels between the (K−1)-th sample brightness level DBV[K−1] and the K-th sample brightness level DBV[K].

Figure 12:
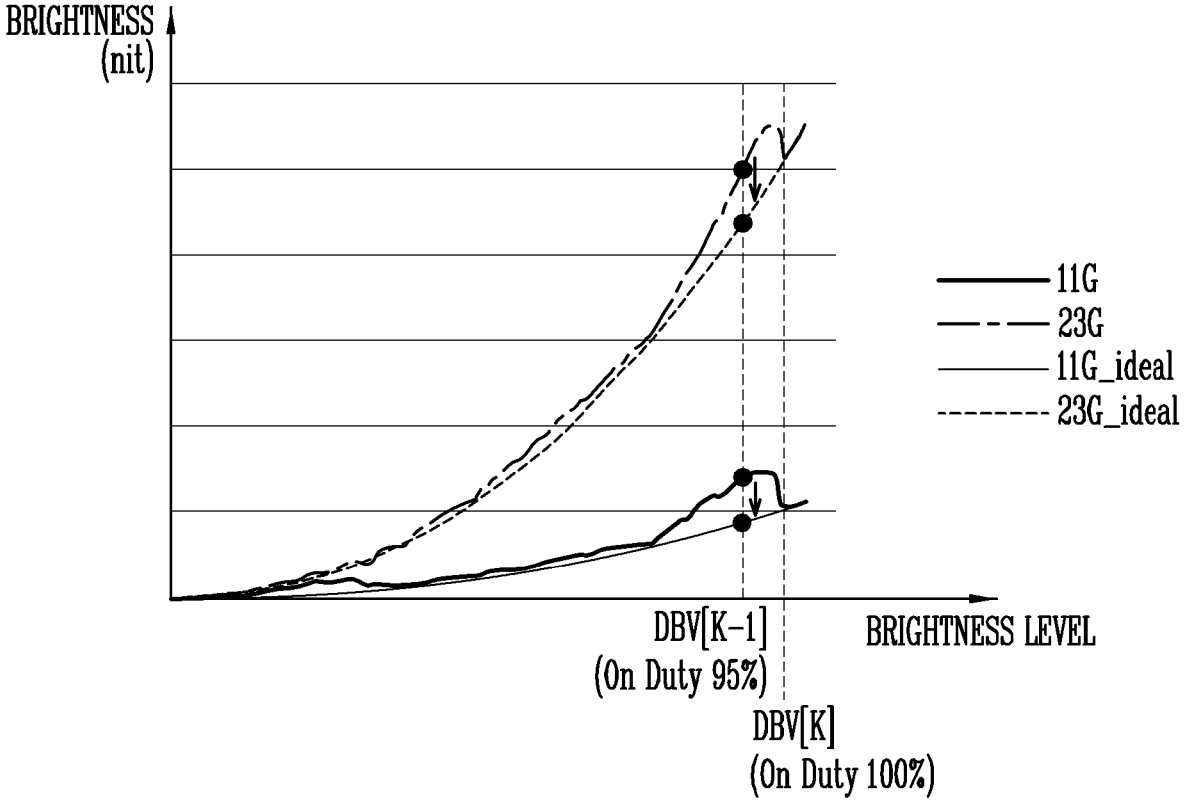
FIGS. 12 and 13 are graphs illustrating the actual brightness measured in the first brightness region according to the sample brightness levels of the first brightness region set in accordance with another embodiment of the present disclosure.
Figure 13:
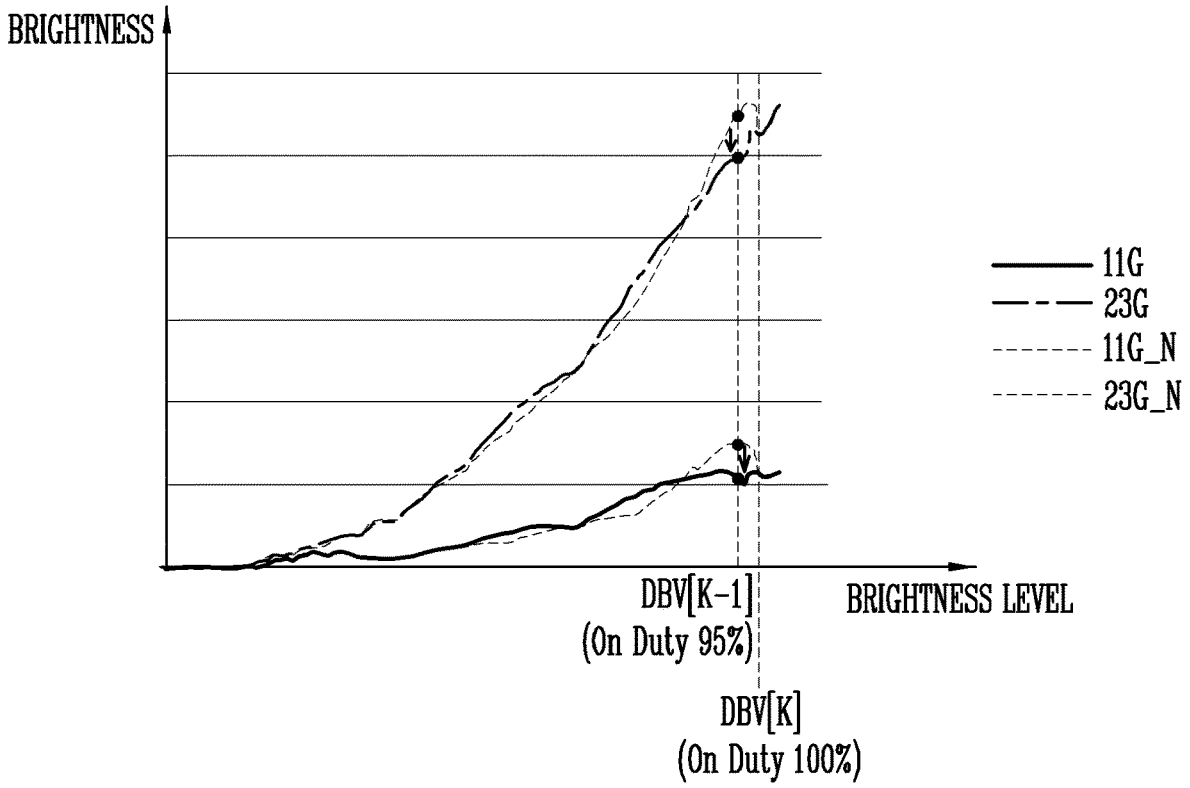

FIGS. 12 and 13 are graphs illustrating the actual brightness measured in the first brightness region according to the sample brightness levels of the first brightness region set in accordance with another embodiment of the present disclosure.

First, referring to FIG. 12, in an embodiment, a width of the last interpolation section of the first brightness region is reduced so that the difference between the on duty values is within 10% (e.g., less than or equal to 10% shorter than the light emission time of the pixels corresponding to the K-th sample brightness level). For example, the (K−1)-th sample brightness level DBV[K−1] may be disposed at a point where the on duty value is 90% or more (e.g., set to a range of 90% to 100% of the light emission time of the pixels corresponding to the K-th sample brightness level), for example, the on duty value may be in a range of 90% to 95%, compared to the reference brightness level positioned at the boundary between the first brightness region and the second brightness region (e.g., the K-th sample brightness level DBV[K]). Therefore, the interval between the K-th sample brightness level DBV[K] and the (K−1)-th sample brightness level DBV[K−1] may be reduced to a range in which the on duty difference is within 10%. For example, the (K−1)-th sample brightness level DBV[K−1] may be disposed at a point where the on duty value is set to 95%.

In an embodiment, in comparison with the embodiment of FIG. 9, the width of the last interpolation section of the first brightness region may be reduced by changing a set position of at least one sample brightness level, in particular, the (K−1)-th sample brightness level DBV[K−1]. For example, four sample brightness levels may be disposed at points where the on duty values are 15%, 45%, 95% and 100%, respectively.

In some embodiments, an additional sample brightness level may be disposed at a point where the on-duty value corresponds to range of 90% to 95% through addition of the sample brightness level. For example, as the embodiment of FIG. 9, the four sample brightness levels may be disposed at points where the on duty values are 15%, 30%, 60%, and 100%, respectively, and one sample brightness level may additionally be disposed at a point where the on duty value is 95%.

For example, in an embodiment, in the first brightness region where the duty adjustment method is applied, a position of at least one sample brightness level is changed or a new sample brightness level may be added, such that at least one sample brightness level is disposed at a point where the on duty value is 90% or more. Therefore, the width of the last interpolation section of the first brightness region may be reduced such that the difference between the on duty values between the two sample brightness levels is within about 10%.

As described above, according to an embodiment of the present disclosure, the sample brightness levels set in the first brightness region may include at least one sample brightness level (for example, the (K−1)-th sample brightness level DBV[K−1]) set such that the light emission time decreases by an amount less than or equal to 10% of the duty value of the reference brightness level (the K-th sample brightness level DBV[K]). Therefore, the brightness reversal phenomenon may be reduced or prevented from occurring at a boundary portion of the first brightness region adjacent to the second brightness region.

For example, the (K−1)-th sample brightness level DBV[K−1] may be disposed at a point where the on duty value corresponds to a range of 90% to 95%, and the gamma data for the reference gray levels may be set for the (K−1)-th sample brightness level DBV[K−1] through the MTP process or the like so that the actual brightness is closer to the target brightness. Therefore, the actual brightness of the (K−1)-th sample brightness level DBV[K−1] and its periphery may be corrected to match the target brightness more closely.

Referring to FIG. 13, as a result of disposing the (K−1)-th sample brightness level DBV[K−1] at a point where the on duty value is 95% and measuring a change of the actual brightness according to the brightness level, with respect to, for example, each of the gray level 11 (e.g., 11G) and the gray level 23 (e.g., 23G) corresponding to a low gray level range, the brightness reversal phenomenon may be suppressed and the gamma curve may be improved.

According to the above-described embodiment, in the boundary portion between the brightness regions where the off duty value of the light emission control signal ESn starts to increase, for example, the last interpolation section of the first brightness region, the brightness increase according to the off bias characteristic of the driving transistor may be compensated through gamma adjustment. Therefore, the brightness of the display area may be controlled more effectively and naturally (e.g., gradually or monotonically) over the entire brightness level by preventing or attenuating (or reducing or mitigating) the brightness reversal phenomenon that may occur between the brightness levels in some sections of the first brightness region (e.g., the last interpolation interval).

Figure 14:
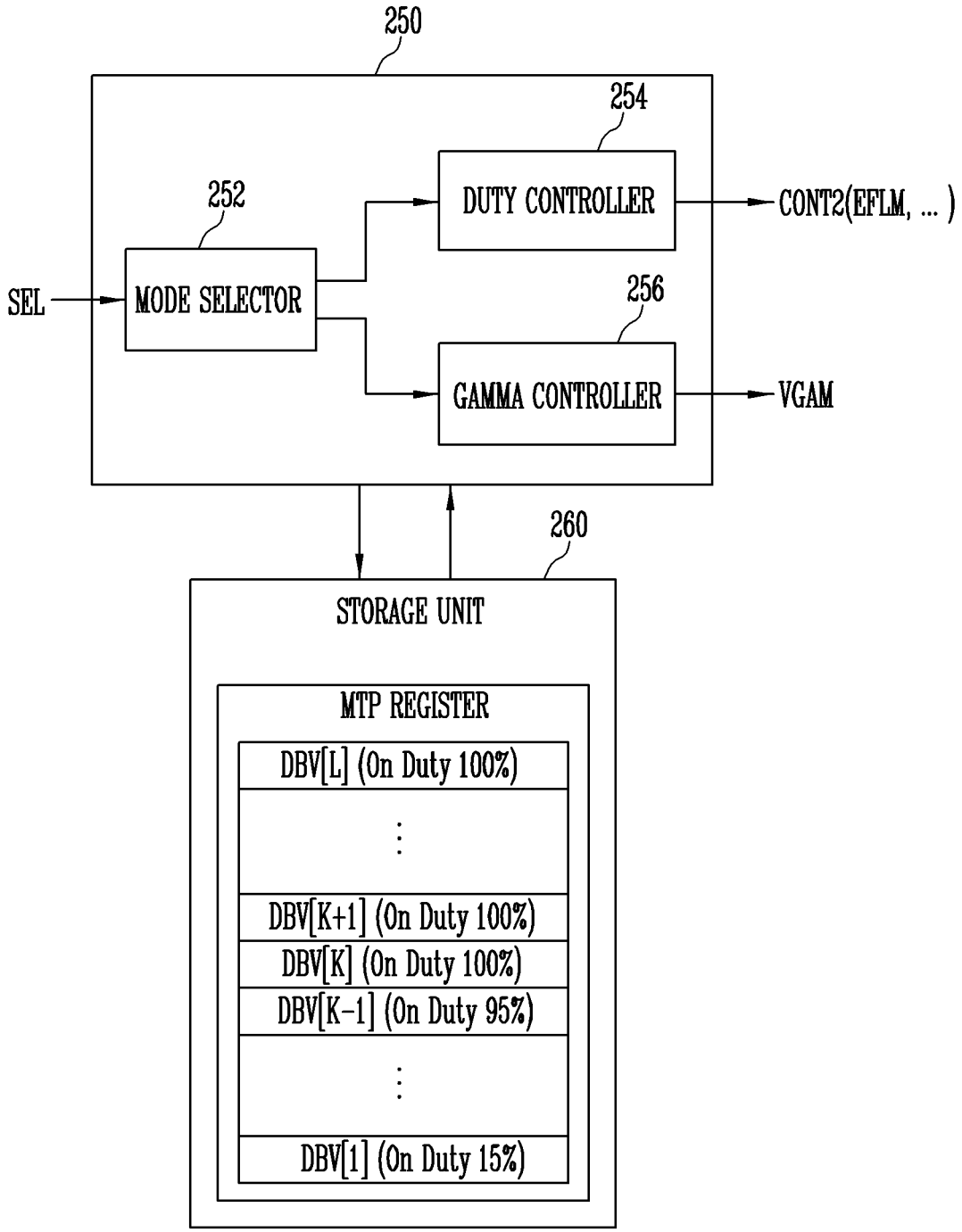
FIG. 14 is a block diagram illustrating a brightness controller and a storage unit according to an embodiment of the present disclosure.

FIG. 14 is a block diagram illustrating the brightness controller 250 and a storage unit 260 according to an embodiment of the present disclosure. According to an embodiment, the brightness controller 250 and the storage unit 260 may be positioned (e.g., located) in the controller 240 of FIG. 1, but are not limited thereto.

Referring to FIG. 14, the brightness controller 250 may include a mode selector 252, a duty controller 254, and a gamma controller 256. The brightness controller 250 may receive the brightness selection signal SEL and output the second control signal CONT2 and the gamma data VGAM in accordance with the brightness selection signal SEL. For convenience of description, each driving block of the brightness controller 250 (e.g., the mode selector 252, the duty controller 254, and the gamma controller 256) are separately shown in FIG. 14; however, the mode selector 252, the duty controller 254, and/or the gamma controller 256 may be merged into one driving block.

The mode selector 252 determines a brightness level corresponding to the input brightness selection signal SEL, and selects any one of the first and second brightness control modes according to the brightness region to which the brightness level corresponding to the input brightness selection signal SEL belongs. For example, the mode selector 252 may include section information on the first brightness region and the second brightness region, and select any one of the first and second brightness control modes using the section information. For example, when it is determined that the brightness level corresponding to the brightness selection signal SEL belongs to the first brightness region, the mode selector 252 may select the first brightness control mode, and when it is determined that the brightness level corresponding to the brightness selection signal SEL belongs to the second brightness region, the mode selector 252 may select the second brightness control mode. Operations of the duty controller 254 and the gamma controller 256 may be controlled in accordance with the first or second brightness control mode selected by the mode selector 252.

The duty controller 254 may control the light emission time of the pixels PX to decrease as much as each brightness level in accordance with the first brightness control mode, and may control the light emission time of the pixels PX to maintain a reference time (e.g., a predetermined reference time) in accordance with the second brightness control mode. To this end, the duty controller 254 may output a light emission start signal EFLM having a pulse width corresponding to the light emission time of the pixels PX. For example, in the first brightness control mode, the duty controller 254 may adjust the pulse width of the light emission start signal EFLM such that the off duty value of the light emission control signal ESn increases as the brightness level decreases, and output the light emission start signal EFLM. In addition, in the second brightness control mode, the duty controller 254 may output the light emission start signal EFLM having a constant pulse width (for example, an initially set pulse width) such that the off duty value of the light emission control signal ESn is maintained to be constant regardless of the brightness level. The light emission start signal EFLM is included in the second control signal CONT2 and supplied to the light emission control driver 220 to be used in generating the light emission control signal ESn.

The gamma controller 256 outputs the gamma data VGAM corresponding to each brightness level according to the brightness selection signal SEL with reference to the storage unit 260 in the first and second brightness control modes. For example, the gamma controller 256 may differentially adjust and output the gamma data VGAM of the reference gray levels according to each brightness level in the first and second brightness control modes. For example, the gamma controller 250 may output the gamma data VGAM for controlling the light emission brightness of the pixels PX to increase as the brightness level increases in the second brightness control mode, and may adjust and output the gamma data VGAM of the reference gray levels so that the light emission brightness of the pixels PX according to the adjustment of the duty value and gamma increases as the brightness level increases in the first brightness control mode (e.g., brightness may be controlled by adjusting gamma in the second mode, and controlled by adjusting duty value and gamma in the first mode). The gamma data VGAM is supplied to the data driver 230 and used in generating the data signal DS.

The storage unit 260 may store gamma data corresponding to the reference brightness level (K-th sample brightness level DBV[K]), a first gamma data set including gamma data corresponding to each of at least one sample brightness level (e.g., first to K-th sample brightness levels DBV[1] to DBV[K−1]) belonging to the first brightness region, and a second gamma data set including gamma data corresponding to each of at least one sample brightness level (for example, (K+1)-th to L-th sample brightness levels DBV[K+1] to DBV[L]) belonging to the second brightness region. For example, the storage unit 260 may include a multi time programming (MTP) register in which the reference gamma voltages correspond to the reference gray levels are repeatedly stored with respect to each of the reference brightness level (K-th sample brightness level DBV[K]) and the sample brightness levels of the first and second brightness regions.

According to an embodiment, the first gamma data set stored in the storage unit 260 may include gamma data corresponding to at least one sample brightness level set in which the light emission time of the pixels PX is shorter than the light emission time of the reference brightness level by less than or equal to 10% of the on duty value of the reference brightness level (K-th sample brightness level DBV[K]) (e.g., set between 90% and 100% of the light emission time of the K-th sample brightness level DBV[K]). For example, the first gamma data set may include gamma data corresponding to the (K−1)-th sample brightness level DBV[K−1] in which the light emission time of the pixels PX is set to 95% of the light emission time of the reference brightness level (K-th sample brightness level DBV[K]).

Figure 15:
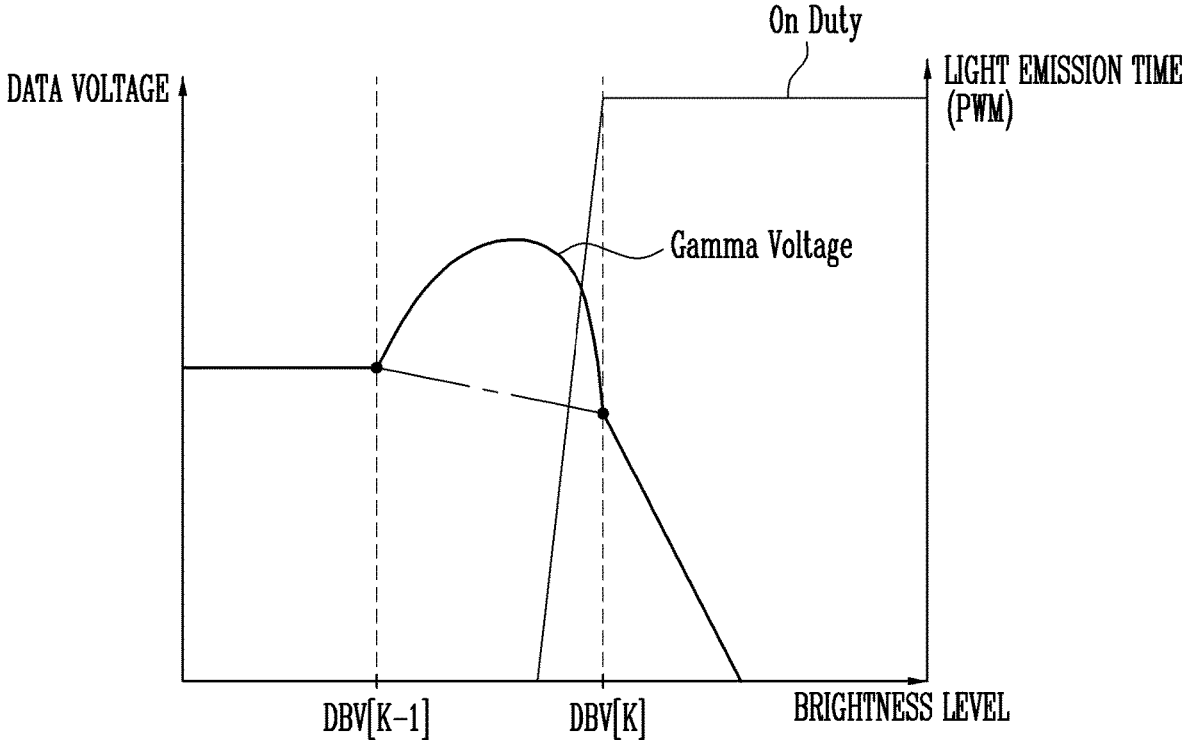
FIG. 15 is a graph illustrating a change of a data voltage and a light emission time according to a brightness level, according to an embodiment of the present disclosure.

FIG. 15 is a graph illustrating a change of the data voltage and the light emission time according to the brightness level, according to an embodiment of the disclosure. For example, FIG. 15 is a graph illustrating an embodiment of the present disclosure for reducing or preventing the brightness reversal phenomenon that may occur between the (K−1)-th sample brightness level DBV[K−1] and the K-th sample brightness level DBV[K], and illustrates the change of the data voltage and the light emission time according to each brightness level based on the (K−1)-th sample brightness level DBV [K−1], the K-th sample brightness level DBV[K], and some brightness levels in the vicinity thereof. That is, in FIG. 15 illustrates the change of the data voltage and the light emission time for the (K−1)-th sample brightness level DBV[K−1], the K-th sample brightness level DBV[K], and some brightness levels in the vicinity thereof.

Referring to FIGS. 1 to 11 and 15, in an embodiment of the present disclosure, each value of gamma data VGAM is calculated through non-linear interpolation with respect to at least some brightness levels (e.g., all brightness levels) between the (K−1)-th sample brightness level DBV[K−1] and the K-th sample brightness level DBV[K] (e.g., the last gamma interpolation section of the first brightness region). For example, the brightness controller 250 may set the sample brightness levels as in the embodiment of FIG. 9, and may calculate each value of gamma data VGAM through non-linear interpolation using a quadratic equation with respect to at least some brightness levels between the (K−1)-th sample brightness level DBV[K−1] and the K-th sample brightness level DBV[K].

For example, the brightness controller 250 may calculate each value of gamma data VGAM using a quadratic function that sets the gamma data to a form in which the brightness of the display area 100 is gradually decreased and then increased again as each brightness level increases with respect to at least some brightness levels. For example, when the driving transistor of the pixel PX is a P type transistor, the brightness decreases as the data voltage for each gray level increases. Therefore, in this case, each value of gamma data VGAM for at least some brightness levels (e.g., all brightness levels) between the (K−1)-th sample brightness level DBV[K−1] and the K-th sample brightness level DBV[K] may be calculated through gamma interpolation using a quadratic equation of a convex function (e.g., a convex quadratic function) that sets a form in which the gamma data VGAM for each reference gray level for generating the data voltage is gradually increased and then decreased again as the brightness level increases. In contrast, when the driving transistor of the pixel PX is an N type transistor, each gamma data VGAM for at least some brightness levels (e.g., all brightness levels) between the (K−1)-th sample brightness level DBV[K−1] and the K-th sample brightness level DBV[K] may be calculated through gamma interpolation using a quadratic equation of a concave function (e.g., a concave quadratic function).

In an embodiment, the quadratic equation (e.g., the concave or convex quadratic function) for calculating the gamma data VGAM for each brightness level between the (K−1)-th sample brightness level DBV[K−1] and the K-th sample brightness level DBV[K] may be set according to a brightness characteristic of the display panel. For example, with respect to the brightness levels between the (K−1)-th sample brightness level DBV[K−1] and the K-th sample brightness level DBV[K], the target brightness may be set for a brightness level (e.g., a predetermined brightness level in which the on duty value is set to 90% to 95%) of a point where the brightness reversal phenomenon is most severe so as to reduce or prevent or minimize the brightness reversal phenomenon for each reference gray level. In addition, a function equation may be set to achieve the target brightness, and the gamma data VGAM for each brightness level between the (K−1)-th sample brightness level DBV[K−1] and the K-th sample brightness level DBV[K] may be calculated according to the function equation.

In some embodiments, the brightness controller 250 may calculate each gamma data VGAM or the duty value through linear interpolation, with respect to the remaining brightness levels between the sample brightness levels (e.g., the remaining brightness levels), except for at least some brightness levels between the (K−1)-th sample brightness level DBV[K−1] and the K-th sample brightness level DBV[K]. For example, the brightness controller 250 may calculate each gamma data VGAM through linear interpolation with respect to all gamma interpolation sections of the second brightness region and the remaining gamma interpolation sections of the first brightness region, except for the (K−1)-th sample brightness level DBV[K−1] and the K-th sample brightness level DBV[K] which are the last interpolation sections, and may calculate each duty value through linear interpolation with respect to all duty interpolation sections of the first brightness region.

According to the above-described embodiment, in the brightness region between the (K−1)-th sample brightness level DBV[K−1] and the K-th sample brightness level DBV[K] (e.g., the last gamma interpolation section of the first brightness region set to the low brightness region), the gamma data VGAM corresponding to each brightness level is calculated using a quadratic equation set in consideration of a brightness characteristic measured in the display panel. Therefore, the brightness reversal phenomenon may be reduced or prevented from occurring between the (K−1)-th sample brightness level DBV[K−1] and the K-th sample brightness level DBV[K], and the brightness of the display area 100 may be naturally (e.g., gradually) controlled in accordance with each brightness level. In addition, in the above-described embodiment, the brightness reversal phenomenon may be prevented (e.g., reduced or attenuated) without further dividing the gamma interpolation section.

Therefore, the brightness of the display area 100 may be smoothly (e.g., monotonically) controlled according to each brightness level without increasing the number of sample brightness levels. Thus, because it is not necessary to secure additional storage space, the driving circuit 200 may operate more efficiently.

Figure 16:
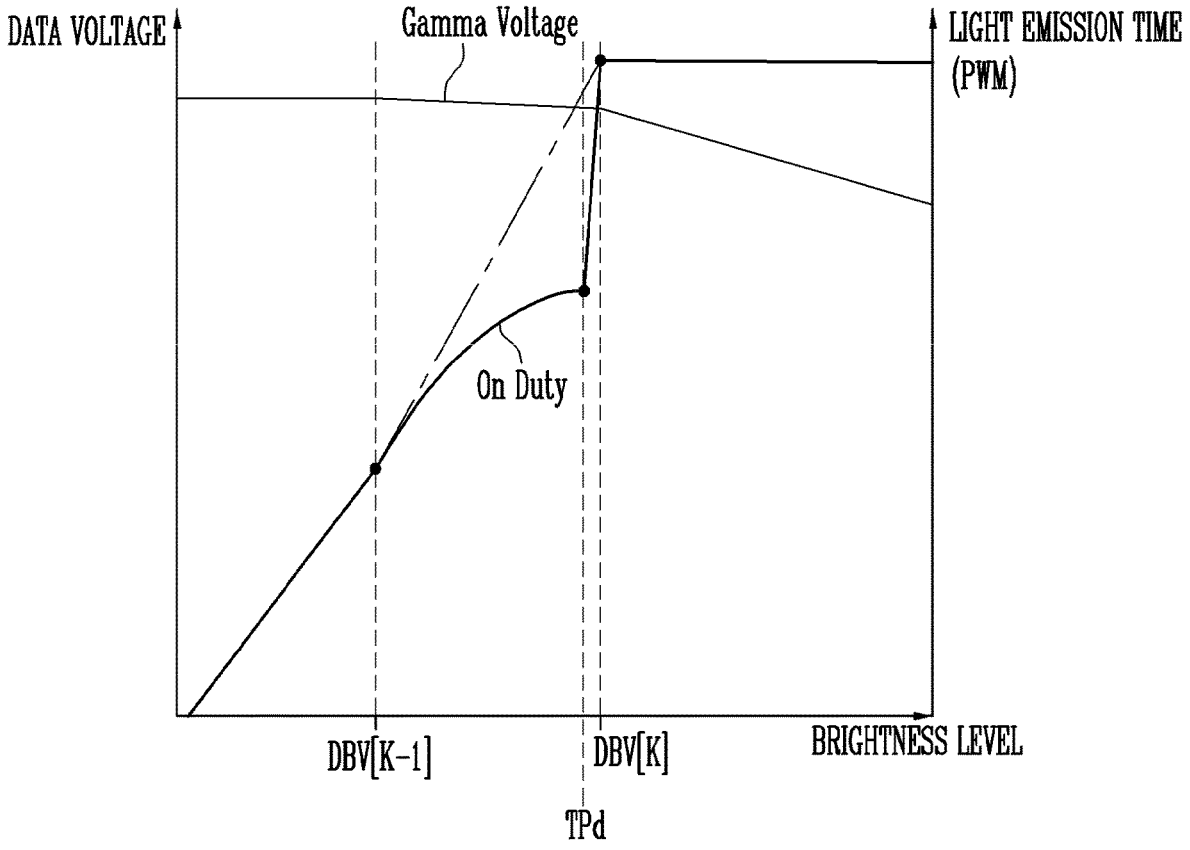
FIG. 16 is a graph illustrating a change of the data voltage and the light emission time according to the brightness level, according to an embodiment of the present disclosure.

FIG. 16 is a graph of the change of the data voltage and the light emission time for the (K−1)-th sample brightness level DBV[K−1], the K-th sample brightness level DBV[K], and some brightness levels in the vicinity thereof according to another embodiment for reducing or preventing the brightness reversal phenomenon that may occur between the (K−1)-th sample brightness level DBV[K−1] and the K-th sample brightness level DBV[K], and illustrates the change of the data voltage and the light emission time according to each brightness level based on the (K−1)-th sample brightness level DBV[K−1] and the K-th sample brightness level DBV[K]. That is, in FIG. 16 illustrates the change of the data voltage and the light emission time for the (K−1)-th sample brightness level DBV[K−1], the K-th sample brightness level DBV[K], and some brightness levels in the vicinity thereof.

Referring to FIGS. 1 to 11 and 16, in an embodiment of the present disclosure, each duty value is calculated through non-linear interpolation with respect to at least some brightness levels between the (K−1)-th sample brightness level DBV[K−1] and the K-th sample brightness level DBV[K]. For example, in the present embodiment, at least one duty tap point (hereinafter, referred to as a "duty tuning point TPd") for the duty adjustment is additionally set between the (K−1)-th sample brightness level DBV[K−1] and the K-th sample brightness level DBV[K], and a duty value set according to a tuning point target brightness at the duty tuning point TPd is further stored in the display device 10 (e.g., the storage unit included in the controller 240).

For example, in the present embodiment, a tuning point brightness level between the (K−1)-th sample brightness level DBV[K−1] and the K-th sample brightness level DBV[K] may be set as the additional duty tuning point TPd, the duty value may be set to achieve a target brightness value at the tuning point brightness level, and the duty value may be stored in the display device 10. For example, a brightness level at which the brightness reversal phenomenon is most severe (e.g., a predetermined brightness level at which the on duty value is set to 90% to 95%) may be set as the duty tuning point TPd, and the duty value set with respect to the duty tuning point TPd may be used for the duty interpolation together with the duty values set with respect to the sample brightness levels (e.g., the duty value set with respect to the (K−1)-th sample brightness level DBV[K−1] and the K-th sample brightness level DBV[K]).

For example, the brightness controller 250 may calculate each duty value through non-linear interpolation using a quadratic equation set to prevent or reduce the brightness reversal phenomenon, with respect to brightness levels between the (K−1)-th sample brightness level DBV[K−1] and a tuning point brightness level corresponding to the duty tuning point TPd (e.g., the predetermined duty tuning point TPd). The brightness controller 250 may calculate the duty value corresponding to each brightness level through linear interpolation, with respect to the remaining duty interpolation sections (e.g., each duty interpolation section including the brightness levels between the (K−1)-th sample brightness level DBV[K−1] and the K-th sample brightness level DBV[K], and a duty interpolation section including the brightness levels between the tuning point brightness level corresponding to the duty tuning point TPd and the K-th sample brightness level DBV[K]).

In some embodiments, the brightness controller 250 may calculate the gamma data VGAM corresponding to each brightness level through linear interpolation with respect to the brightness levels of each gamma interpolation section. For example, the brightness controller 250 may calculate the gamma data VGAM corresponding to each brightness level through linear interpolation with respect to all brightness levels between the sample brightness levels in addition to the brightness levels between the (K−1)-th sample brightness level DBV[K−1] and the K-th sample brightness level DBV[K].

According to the above-described embodiment, at least one duty tuning point TPd is disposed in the brightness region between the (K−1)-th sample brightness level DBV[K−1] and the K-th sample brightness level DBV[K]. In addition, a duty value is set to obtain the target brightness at the tuning point brightness level corresponding to the duty tuning point TPd, and the duty interpolation is performed between the (K−1)-th sample brightness level DBV[K−1] and the K-th sample brightness level DBV[K] using the duty value. Therefore, the brightness reversal phenomenon may be reduced or prevented from occurring between the (K−1)-th sample brightness level DBV[K−1] and the K-th sample brightness level DBV[K], and the brightness of the display area 100 may be naturally (e.g., gradually or finely) controlled in accordance with each brightness level.

Figure 17:
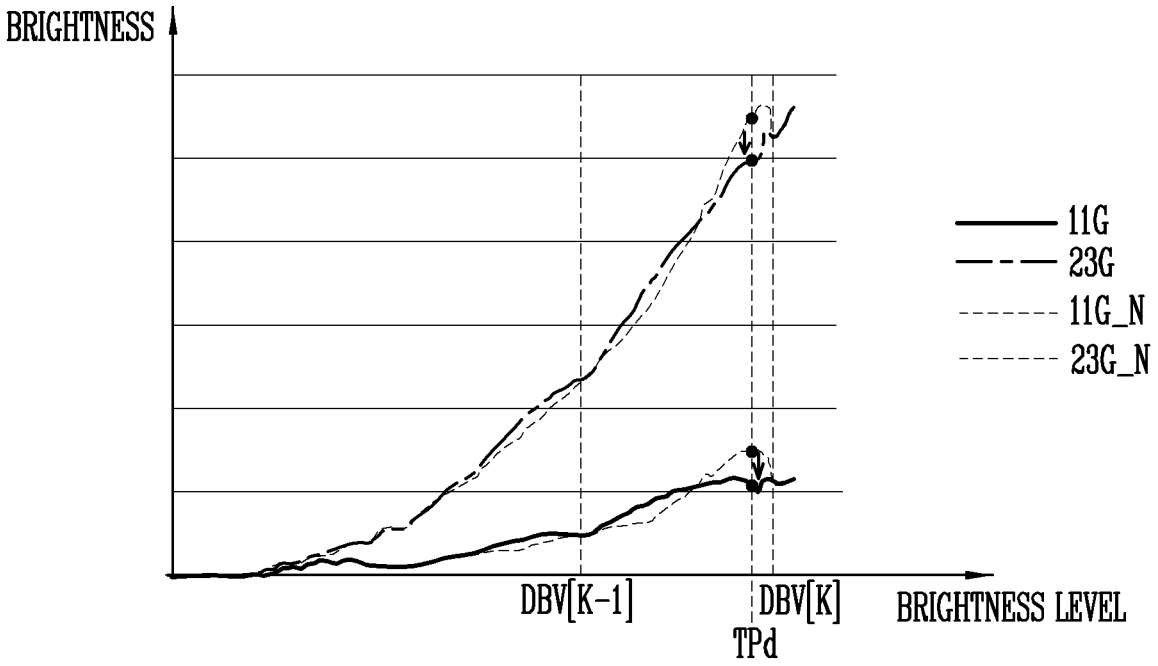
FIG. 17 is a graph illustrating a brightness measured in the first brightness region of the display device according to an embodiment of the present disclosure.

FIG. 17 is a graph illustrating a brightness measured in the first brightness region of the display device according to an embodiment of the disclosure. For example, FIG. 17 illustrates a brightness measured in the first brightness region of the display device 10 according to the embodiments of FIGS. 15 and 16.

As shown in the embodiments of FIG. 15 and FIG. 16, with respect to at least some brightness levels between the (K−1)-th sample brightness level DBV[K−1] and the K-th sample brightness level DBV[K], each gamma data VGAM or duty value may be calculated using non-linear interpolation and a quadratic equation set to more closely match the target brightness and prevent (e.g., reduce or attenuate) the brightness reversal phenomenon, as shown in FIG. 17. In addition, the brightness reversal phenomenon may be prevented (e.g., reduced or attenuated) by applying the embodiments of FIGS. 15 and 16. For example, with respect to at least some brightness levels between the (K−1)-th sample brightness level DBV[K−1] and the K-th sample brightness level DBV[K], each gamma data VGAM or duty value may be calculated through non-linear interpolation using a quadratic equation.

According to the above-described embodiments, in the boundary portion between the brightness regions where the off duty value of the light emission control signal ESn starts to increase (e.g., in the last gamma interpolation section of the first brightness region), the brightness increase corresponding to the off bias characteristic of the driving transistor may be reduced by applying the gamma interpolation method and/or the duty interpolation method. Therefore, the brightness of the display area 100 may be controlled more naturally (e.g., gradually or monotonically) in accordance with each brightness level by preventing (e.g., reducing or attenuating) the brightness reversal phenomenon that may occur between the brightness levels.

Figure 18:
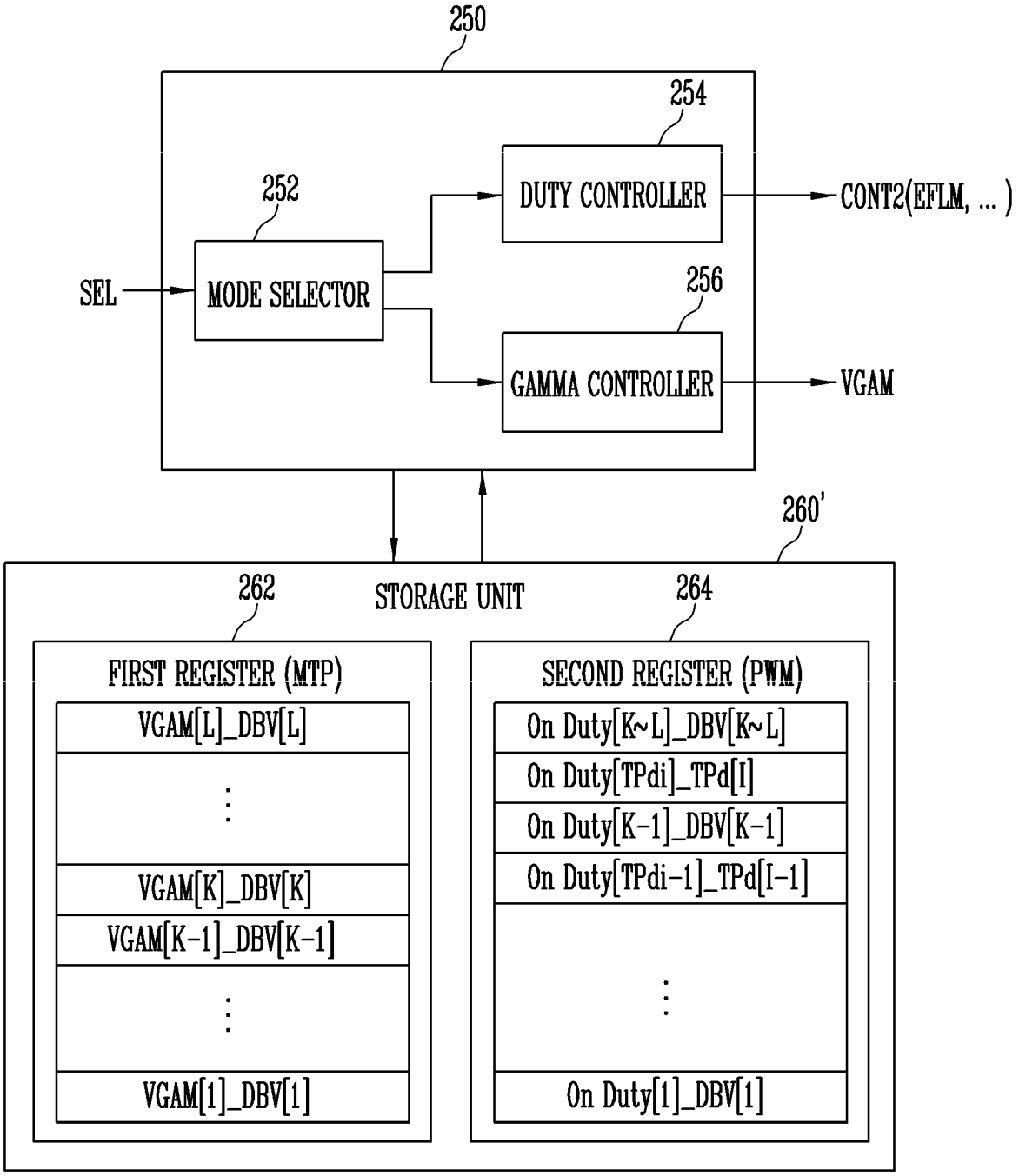
FIG. 18 is a block diagram illustrating the brightness controller and the storage unit according to an embodiment of the present disclosure.

FIG. 18 is a block diagram illustrating the brightness controller 250 and the storage unit 260' according to an embodiment of the present disclosure. According to an embodiment, the brightness controller 250 and the storage unit 260' may be included in the display driver 200 (e.g., the brightness controller 250 and the storage unit 260' may be included in the controller 240 of FIG. 1). The storage unit 260' may have a configuration substantially similar to that of the storage unit 260 described with reference to FIG. 14.

Referring to FIG. 18, the brightness controller 250 may include a mode selector 252, a duty controller 254, and a gamma controller 256. The brightness controller 250 may receive the brightness selection signal SEL and output the second control signal CONT2 and the gamma data VGAM in accordance with the brightness selection signal SEL. For example, the brightness controller 250 may control the brightness of the display area 100 according to each brightness level corresponding to the brightness selection signal SEL with reference to the storage unit 260'. For convenience of description, each driving block of the brightness controller 250 (e.g., the mode selector 252, the duty controller 254, and the gamma controller 256) are separately shown in FIG. 18; however, the mode selector 252, the duty controller 254, and/or the gamma controller 256 may be merged into one driving block.

The mode selector 252 determines a brightness level corresponding to the input brightness selection signal SEL, and selects any one of the first and second brightness control modes according to the brightness region to which the brightness level belongs. For example, the mode selector 252 may include section information on the first brightness region and the second brightness region, and may select any one of the first and second brightness control modes using the section information. For example, when it is determined that the brightness level corresponding to the brightness selection signal SEL belongs to the first brightness region, the mode selector 252 may select the first brightness control mode, and when it is determined that the brightness level corresponding to the brightness selection signal SEL belongs to the second brightness region, the mode selector 252 may select the second brightness control mode. Operations of the duty controller 254 and the gamma controller 256 may be controlled in accordance with the first or second brightness control mode selected by the mode selector 252.

In the first and second brightness control modes, the duty controller 254 may output the second control signal CONT2 corresponding to each brightness level in accordance with the brightness selection signal SEL and with reference to the storage unit 260'. For example, the duty controller 254 may output the second control signal CONT2 for controlling the light emission time of the pixels PX to decrease as much as each brightness level in accordance with the first brightness control mode and for controlling the light emission time of the pixels PX to maintain a reference time (e.g., a predetermined reference time) in accordance with the second brightness control mode. To this end, the duty controller 254 may output a light emission start signal EFLM having a pulse width corresponding to the light emission time of the pixels PX.

For example, the duty controller 254 may adjust the duty value according to each brightness level in the first brightness control mode and maintain the duty value to be held constant regardless of each brightness level in the second brightness control mode. The duty controller 254 may output the second control signal CONT2 corresponding to the duty value set according to each brightness level. For example, the duty controller 254 may output the second control signal CONT2 including the light emission start signal EFLM having a pulse width corresponding to the duty value set according to each brightness level.

For example, in the first brightness control mode, the duty controller 254 may adjust the pulse width of the light emission start signal EFLM such that the on duty value of the light emission control signal ESn decreases as the brightness level decreases, and output the light emission start signal EFLM. In addition, in the second brightness control mode, the duty controller 254 may output the light emission start signal EFLM having a constant pulse width (e.g., a maximum pulse width, e.g., a predetermined maximum pulse width) such that the on duty value of the light emission control signal ESn is held constant regardless of the brightness level. The light emission start signal EFLM may be included in the second control signal CONT2 and supplied to the light emission control driver 220 for use in generating the light emission control signal ESn.

In an embodiment, the duty controller 254 may calculate the duty value through linear interpolation in the entire first brightness region as described in the embodiment of FIG. 15. In another embodiment, the duty controller 254 may calculate the duty value for each brightness level of the first brightness region through the duty adjustment method described in the embodiment of FIG. 16. For example, the duty controller 254 may calculate the duty value through non-linear interpolation for at least some brightness levels in the brightness region between the (K−1)-th sample brightness level DBV[K−1] and the K-th sample brightness level DBV[K].

The gamma controller 256 outputs the gamma data VGAM corresponding to each brightness level in accordance with the brightness selection signal SEL and with reference to the storage unit 260' in the first and second brightness control modes. For example, the gamma controller 256 may differentially adjust and output the gamma data VGAM of the reference gray levels according to each brightness level in the first and second brightness control modes. For example, the gamma controller 256 may output the gamma data VGAM for increasing the light emission brightness of the pixels PX to increase as the brightness level increases in the second brightness control mode, and may adjust and output the gamma data VGAM of the reference gray levels so that the light emission brightness of the pixels PX, according to the adjustment of both the duty value and gamma, increases as the brightness level increases in the first brightness control mode. The gamma data VGAM may be supplied to the data driver 230 and used in generating the data signal DS.

In an embodiment, as described in the embodiment of FIG. 15, the gamma controller 256 may calculate the gamma data VGAM according to each brightness level through non-linear interpolation such that the brightness reversal phenomenon is prevented (e.g., reduced or attenuated) in the last gamma interpolation section (e.g., the brightness region including the brightness levels between the (K−1)-th sample brightness level DBV[K−1] and the K-th sample brightness level DBV[K]). In addition, the duty value may be calculated through linear interpolation with respect to the remaining gamma interpolation sections. In another embodiment, as described in the embodiment of FIG. 16, the gamma controller 256 may calculate each gamma data VGAM through linear interpolation for all gamma interpolation sections between the sample brightness levels.

The storage unit 260' may store the gamma data VGAM and the duty value corresponding to each of the plurality of sample brightness levels including the reference brightness level (K-th sample brightness level DBV[K]). For example, the storage unit 260' may include a first register 262 in which the gamma voltages corresponding to reference gray levels (e.g., predetermined reference gray levels) are stored for each of the sample brightness levels, and a second register 264 in which the duty value for each of the sample brightness levels is stored. In an embodiment, the storage unit 260' may also store the duty value corresponding to the tuning point brightness level for the additional duty tuning point TPd between the (K−1)-th sample brightness level DBV[K−1] and the K-th sample brightness level DBV[K].

The first register 262 may include the gamma data VGAM corresponding to reference gray levels (e.g., predetermined reference gray levels) with respect to each of the sample brightness levels. For example, the first register 262 may include first to L-th gamma data VGAM[1] to VGAM[L] corresponding to the first to L-th sample brightness levels DBV[1] to DBV[L], respectively. In an embodiment, the first register 262 may be a multi time programming (MTP) register in which the gamma voltages corresponding to the reference gray levels are repeatedly stored with respect to each sample brightness level, but is not limited thereto.

The second register 264 may store the duty value for each of the first to (K−1)-th sample brightness levels DBV[1] to DBV[K−1] and the duty value for the brightness level of the K-th sample brightness level DBV[K] or more (e.g., the K-th to L-th sample brightness levels DBV[K] to DBV[L]). For example, the second register 264 may be a PWM register in which on duty values On Duty[1] to On Duty[K−1] for each of the first to (K−1)-th sample brightness levels DBV[1] to DBV[K−1] and on duty values On Duty[K] to On Duty[L] for each of the K-th sample brightness level DBV[K] or more (e.g., the K-th to L-th sample brightness levels DBV[K] to DBV[L]) are stored. According to an embodiment, the on duty values stored in the second register 264 may be initial setting values set before shipment of the display device 10.

In an embodiment, the second register 264 may also selectively store on duty values corresponding to the tuning point brightness levels between the (K−1)-th sample brightness level DBV[K−1] and the K-th sample brightness level DBV[K]. In addition, according to an embodiment, the second register 264 may also store on duty values corresponding to a plurality of duty tuning points TPd in addition to the on duty values corresponding to the sample brightness levels.

For example, in the first brightness region, the additional duty tuning points TPd may be further disposed between the sample brightness levels for more precise duty interpolation, in addition to the sample brightness levels (e.g., the first to K-th sample brightness levels DBV[1] to DBV[K]). In this case, the second register 264 may store an on duty value corresponding to the duty tuning points TPd. For example, the second register 264 may store an on duty value On Duty[TPdi] corresponding to an I-th (I is a natural number) tuning point brightness level between the (K−1)-th sample brightness level DBV[K−1] and the K-th sample brightness level DBV[K], and an on duty value On Duty[TPdi−1] corresponding to an (I−1)-th duty tuning point TPd[I−1] corresponding to other brightness levels between the first sample brightness level DBV[1] and the (K−1)-th sample brightness level DBV[K−1]. In this case, the first brightness region may include more detailed duty interpolation sections, and thus the duty value according to each brightness level of the first brightness region may be more precisely adjusted.

Figure 19:
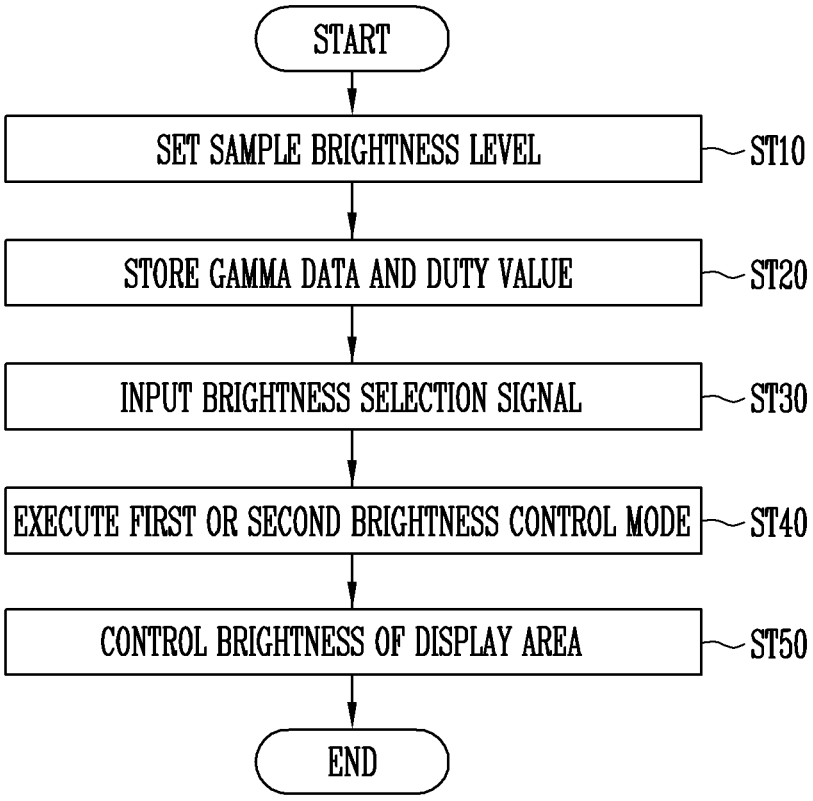
FIG. 19 is a flowchart illustrating a method of controlling a brightness of the display device according to an embodiment of the present disclosure.

FIG. 19 is a flowchart illustrating a method of controlling a brightness of the display device 10 according to an embodiment of the present disclosure. In describing the embodiment of FIG. 19, descriptions of parts similar or identical to those of the above-described embodiments will not be repeated.

Referring to FIG. 19, the method of controlling the brightness of the display device 10 according to an embodiment of the present disclosure may include setting the sample brightness level (ST10), storing the gamma data and the duty value (ST20), inputting the brightness selection signal (ST30), executing the first or second brightness control mode (ST40), and controlling the brightness of the display area (ST50).

<Setting the Sample Brightness Level (ST10)>

First, the plurality of sample brightness levels including the reference brightness level (e.g., the predetermined reference brightness level) may be set so that the brightness of the display device 10 may be gradually set. For example, the plurality of sample brightness levels may include the K-th sample brightness level DBV[K], which serves as the reference for dividing the first and second brightness regions, at least one sample brightness level (e.g., the first to (K−1)-th sample brightness level DBV[1] to DBV[K−1]) corresponding to brightness levels lower than the K-th sample brightness level DBV[K], and at least one sample brightness level (e.g., the (K+1)-th to L-th sample brightness level DBV[K+1] to DBV[L]) corresponding to brightness levels higher than the K-th sample brightness level DBV[K]. The sample brightness levels may selectively include at least one brightness level set such that the light emission time of the pixels PX is reduced by a range within 10% of the K-th sample brightness level DBV[K] (e.g., set between 90% and 100% of the light emission time of the K-th sample brightness level DBV[K]). For example, when it is desired to control the brightness of the display device 10 according to the embodiment of FIGS. 12 to 14, in setting the sample brightness levels, the sample brightness levels may be set to include at least one brightness level set to decrease (e.g., reduce) the light emission time of the pixels PX by a range within 10% of the K-th sample brightness level DBV[K] (e.g., set between 90% and 100% of the light emission time of the K-th sample brightness level DBV[K]).

<Storing the Gamma Data and the Duty Value (ST20)>

Next, the gamma data VGAM and the duty value for each of the sample brightness levels may be set and stored. For example, the gamma voltages of the reference gray levels may be repeatedly set and stored in the first register 262, with respect to each of the sample brightness levels, through the MTP process. In addition, the duty value may be set as an initial setting value according to the target brightness for each of the sample brightness levels, and the duty value may be stored in the second register 264.

<Inputting the Brightness Selection Signal (ST30)>

Next, the brightness selection signal SEL may be input to the brightness controller 250. According to an embodiment, the brightness selection signal SEL may be a control signal input to the brightness controller 250 in accordance with the brightness level selected according to an initial setting, a usage environment, and/or a user input.

<Executing the First or Second Brightness Control Mode (ST40)>

Next, the brightness level corresponding to the input brightness selection signal SEL may be determined, and thus, the first or second brightness control mode may be executed. For example, when the brightness level corresponding to the brightness selection signal SEL belongs to the first brightness region, the first brightness control mode may be executed, and when the brightness level corresponding to the brightness selection signal SEL belongs to the second brightness region, the second brightness control mode may be executed.

<Controlling the Brightness of the Display Area (ST50)>

Next, the brightness of the display area 100 is controlled in accordance with the executed first or second brightness control mode. For example, the brightness of the display area 100 may be controlled by using the gamma data VGAM and/or the duty values set for each of the sample brightness levels. The gamma data VGAM and/or the duty value corresponding to each of the brightness levels may be calculated through interpolation using the gamma data VGAM and/or the duty values of the sample brightness levels and brightness levels between the sample brightness levels.

According to an embodiment, in the first brightness control mode, the brightness of the display area 100 may be controlled by differentially adjusting the gamma data VGAM and the light emission time of the pixels PX according to each brightness level. In addition, in the second brightness control mode, the brightness of the display area 100 may be controlled by differentially adjusting the gamma data VGAM according to each brightness level, and the light emission time of the pixels PX may be held constant in accordance with a duty value (e.g., a predetermined duty value).

In an embodiment, each gamma data VGAM and/or duty value may be calculated through non-linear interpolation with respect to at least some brightness levels between the (K−1)-th sample brightness level DBV[K−1] and the K-th sample brightness level DBV[K]. For example, when it is desired to control the brightness of the display device 10 according to at least one of the embodiments of FIGS. 15 to 18, each gamma data VGAM and/or duty value may be calculated through non-linear interpolation using a quadratic equation with respect to the at least some brightness levels, and each gamma data VGAM and/or duty value may be calculated through linear interpolation with respect to the remaining brightness levels between the sample brightness levels.

Through the above-described process, the brightness of the display area 100 may be controlled in correspondence with each brightness level.

While the present invention has been particularly shown and described with reference to some example embodiments thereof, it will be understood by those of ordinary skill in the art that various changes in form and details may be made therein without departing from the spirit and scope of the present invention as set forth in the following claims and their equivalents.

What is claimed is:

1. A display device comprising:

a display area including pixels connected to scan lines, light emission control lines, and data lines; and a display driver configured to drive the pixels in accordance with input image data, timing signals, and a brightness selection signal, the display driver comprising:

a storage unit configured to store gamma data and a duty value for each of a plurality of sample brightness levels including a K-th (K is a natural number of two or more) sample brightness level; and a brightness controller configured to:

control a brightness of the display area according to a brightness level corresponding to the brightness selection signal and with reference to the storage unit, such that brightness levels less than the K-th sample brightness level are controlled according to a first method and brightness levels greater than the K-th sample brightness level are controlled according to a second method that is different from the first method;

and control a light emission time of the pixels according to the brightness level in a first brightness region equal to or less than the K-th sample brightness level, the display driver being configured to control the brightness of the display area according to gamma data obtained by non-linearly interpolating gamma data of a (K−1)-th sample brightness level and the K-th sample brightness level, with respect to a tuning point brightness level that is less than the K-th sample brightness level, and the light emission time of the pixels corresponding to the (K−1)-th sample brightness level being less than or equal to 10% shorter than the light emission time of the pixels corresponding to the K-th sample brightness level.

2. The display device of claim 1, wherein the storage unit is configured to store gamma data corresponding to the tuning point brightness level, and wherein the tuning point brightness level is set to the (K−1)-th sample brightness level.

3. The display device of claim 2, wherein the (K−1)-th sample brightness level is a brightness level at which the light emission time of the pixels is set to a range of 90% to 95% of the light emission time of the pixels corresponding to the K-th sample brightness level.

4. The display device of claim 1, wherein the brightness controller is configured to calculate each gamma data or duty value through non-linear interpolation with respect to at least one brightness level between the (K−1)-th sample brightness level and the K-th sample brightness level.

5. The display device of claim 4, wherein the brightness controller is configured to calculate each gamma data by using a quadratic function that sets the gamma data to gradually decrease the brightness of the display area and then increase again as each brightness level increases with respect to the at least one brightness level.

6. The display device of claim 4, wherein the brightness controller is configured to calculate each duty value through linear interpolation with respect to brightness levels between the (K−1)-th sample brightness level and the K-th sample brightness level.

7. The display device of claim 1, wherein the tuning point brightness level is set to a brightness level between the (K−1)-th sample brightness level and the K-th sample brightness level, and wherein the storage unit is configured to store a duty value corresponding to the brightness level between the (K−1)-th sample brightness level and the K-th sample brightness level.

8. The display device of claim 7, wherein the brightness controller is configured to calculate each duty value through non-linear interpolation using a quadratic function with respect to brightness levels between the (K−1)-th sample brightness level and the tuning point brightness level, and calculates each duty value through linear interpolation with respect to brightness levels between the tuning point brightness level and the K-th sample brightness level.

9. The display device of claim 7, wherein the brightness controller is configured to calculate each gamma data through linear interpolation with respect to brightness levels between the (K−1)-th sample brightness level and the K-th sample brightness level.

10. The display device of claim 7, wherein the tuning point brightness level is a brightness level at which the light emission time of the pixels is set to a range of 90% to 95% of the K-th sample brightness level.

11. The display device of claim 1, wherein the brightness controller is configured to calculate each gamma data and duty value through linear interpolation with respect to brightness levels between sample brightness levels equal to or less than the (K−1)-th sample brightness level and brightness levels between sample brightness levels equal to or greater than the K-th sample brightness level.

12. The display device of claim 1, wherein the brightness controller is configured to control the brightness of the display area by adjusting the light emission time of the pixels and gamma data of reference gray levels according to a first brightness control mode with respect to brightness levels of the first brightness region, and control the brightness of the display area by adjusting the gamma data of the reference gray levels according to a second brightness control mode with respect to brightness levels equal to or greater than the K-th sample brightness level.

13. The display device of claim 12, wherein the brightness controller is configured to output a light emission start signal having a pulse width corresponding to the light emission time of the pixels.

14. The display device of claim 13, wherein the display driver further comprises a light emission control driver that is configured to sequentially supply a light emission control signal to the light emission control lines in accordance with the light emission start signal.

15. The display device of claim 14, wherein the brightness controller is configured to adjust and output the pulse width of the light emission start signal so that an off duty value of the light emission control signal increases as the brightness level according to the brightness selection signal decreases in the first brightness control mode.

16. The display device of claim 14, wherein the brightness controller is configured to maintain the pulse width of the light emission start signal so that an off duty value of the light emission control signal remains constant regardless of the brightness level according to the brightness selection signal in the second brightness control mode.

17. The display device of claim 14, wherein the display driver further comprises a scan driver configured to sequentially supply a scan signal to the scan lines, the scan signal being synchronized with a gate-off period of the light emission control signal.

18. The display device according to claim 12, wherein the display driver further comprises a data driver configured to generate data signals corresponding to the input image data by using the gamma data of the reference gray levels and supply the data signals to the data lines.

19. The display device according to claim 1, wherein the storage unit includes a multi time programming (MTP) register configured to store reference gamma voltages corresponding to predetermined reference gray levels for each of the plurality of sample brightness levels.

20. A method of controlling a brightness of a display device, the method comprising:

setting a plurality of sample brightness levels including a K-th (K is a natural number of two or more) sample brightness level;

storing a plurality of sets of gamma data and a plurality of duty values, each of the sample brightness levels corresponding to one of the sets of gamma data and one of the duty values;

executing a first brightness control mode or a second brightness control mode in accordance with a brightness selection signal; and controlling the brightness of a display area according to a brightness level corresponding to the brightness selection signal, such that brightness levels less than the K-th sample brightness level are controlled according to the first brightness control mode and brightness levels greater than the K-th sample brightness level are controlled according to the second brightness control mode that is different from the first brightness control mode, wherein when the brightness level is in a first brightness region equal to or less than the K-th sample brightness level, the brightness of the display area is controlled by controlling a light emission time of pixels, and wherein the brightness of the display area is controlled according to gamma data obtained by non-linearly interpolating gamma data of a (K−1)-th sample brightness level and the K-th sample brightness level, with respect to a predetermined brightness level that is less than the K-th sample brightness level, and at which the light emission time of the pixels is set to a range of 90% to 100% of the K-th sample brightness level.

* * * * *